US005600405A

United States Patent [19]

Umeda et al.

[11] Patent Number: 5,600,405

[45] Date of Patent: Feb. 4, 1997

[54] BIAS CLEANING SYSTEM AND ELECTROSTATIC PRINTING APPARATUS THEREWITH AND OPERATING METHOD THEREOF

[75] Inventors: Takao Umeda, Mito; Katsuya Kawai, Katsuta; Yosuke Saito, Katsuta; Hiroyuki Mabuchi, Katsuta; Masayasu Anzai, Hitachi; Masato Miwa; Takashi Suzuki, both of Katsuta, all of Japan; Teruaki Mitsuya, Pasadena, Calif.; Yasuo Takuma, Hitachi, Japan; Masato Miwa; Takashi Suzuki, both of Katsuta, Japan; Teruaki Mitsuya, Pasadena, Calif.; Yasuo Takuma, Hitachi, Japan

[73] Assignee: Hitachi, Ltd., Tokyo, Japan

[21] Appl. No.: 257,296

[22] Filed: Jun. 9, 1994

[30] Foreign Application Priority Data

Jun. 14, 1993 [JP] Japan ..... 5-142172

[51] Int. Cl.[6] ..... G03G 21/00

[52] U.S. Cl. ..... 399/71; 399/354

[58] Field of Search ..... 355/301, 302, 355/303, 204, 208

[56] References Cited

U.S. PATENT DOCUMENTS

| | | | |
|---|---|---|---|
| 4,533,236 | 8/1985 | Garsin | 355/303 X |
| 4,615,613 | 10/1986 | Garsin | 355/303 |
| 4,660,962 | 4/1987 | Maekawa et al. | 355/303 |
| 4,786,943 | 11/1988 | Fukae et al. | 355/302 |
| 5,107,285 | 4/1992 | Hamada et al. | 355/296 X |
| 5,233,398 | 8/1993 | Nimura et al. | 355/301 |
| 5,237,377 | 8/1993 | Harada et al. | 355/301 |
| 5,291,253 | 3/1994 | Kumasaka et al. | 355/208 X |

FOREIGN PATENT DOCUMENTS

| | | |
|---|---|---|
| 63-15278 | 1/1980 | Japan . |
| 56-40349 | 9/1981 | Japan . |

*Primary Examiner*—Nestor R. Ramirez

*Attorney, Agent, or Firm*—Antonelli, Terry, Stout & Kraus, LLP

[57] ABSTRACT

A bias cleaning system has an electrically conductive brush roller for collecting toner which has to adhered a transfer belt by scrubbing the toner off the transfer belt under a condition in which a direct current voltage of the opposite polarity to the charge of the toner is applied to the brush roller. A corona charger is also provided for decreasing the amount of charge on the toner on the transfer belt in a region of the belt up-stream of the electrically conductive brush roller in the moving direction of the transfer belt.

25 Claims, 15 Drawing Sheets

BIAS CLEANING SYSTEM AND ELECTROSTATIC PRINTING APPARATUS THEREWITH AND OPERATING METHOD THEREOF

BACKGROUND OF THE INVENTION

The present invention relates to a bias cleaning system, forming a cleaning unit for removing adhered toner from a member carrying toner, such as a transfer belt, an intermediate transfer drum and so on, and to an electro-static printing apparatus therewith and an operating method thereof.

A brush cleaner, a blade cleaner or a bias cleaning system is used as a cleaning system for removing remaining toner on a photosensitive body.

A typical bias cleaning system comprises an electrically conductive brush roller and a collecting roller. The process to remove toner on the surface of a photosensitive body involves applying a voltage to the electrically conductive brush roller and the collecting roller, scrubbing the surface of the photosensitive body with the electrically conductive brush roller, so that the toner on the surface of the photosensitive body electrically and mechanically adheres to the electrically conductive brush roller, and transferring the toner from the electrically conductive brush roller to the collecting roller, which is supplied with higher voltage than the electrically conductive brush roller. The basic construction of a bias cleaning system of this type is described in, for example, Japanese Patent Publication No. 56-40349 (1981).

Further, a cleaning system having means for aligning the polarity of charged toner on a photosensitive body is described in Japanese Patent Application Laid-Open No. 63-15278 (1988). The system will be explained below, referring to FIG. 28 and FIG. 29. The explanation will be made on the assumption that the polarity of the charged toner is negative.

As shown in FIG. 28, the reverse side surface of print paper 7 is positively charged using a transfer corotron 11 so as to have an opposite polarity to that of the toner 8*a* (negatively charged). Therewith, the toner 8*a* developed on a photosensitive drum 1 is transferred to the print paper 7. However, since the positive charge generated by a peeling discharge is supplied to the side of the photosensitive drum 1 charged negatively when the print paper 7 is peeled off from the photosensitive drum 1, a part of the toner 8*b* remaining on the photosensitive drum 1 after the transferring operation is changed to the opposite polarity due to its receiving a positive charge.

In a case where the print paper 7 is not transported to the transfer portion due to a paper jam or the like, the toner on the photosensitive drum 1 virtually becomes opposite in polarity (positive polarity) because of its receiving a positive charge directly from the transfer corotron 11. The remaining toner on the photosensitive drum 1 cannot be cleaned with a bias cleaning system. Therefore, as shown in FIG. 29, the charge polarity of the toner charged to the opposite polarity (positive polarity) is aligned in negative polarity by providing a pre-charger 28 generating a charge having a polarity (negative polarity) opposite to the voltage applied to electrically conductive brush roller 17.

A bias cleaning system has been used as a cleaning system for a photosensitive body, but has not been employed as a cleaning system for cleaning toner adhering to a toner carrying member other than a photosensitive body, such as a transfer belt, transfer roller, intermediate transfer body or the like.

In an electro-static printing apparatus using a transfer belt, a print paper sheet is electro-statically tacked to the transfer belt made of a dielectric material, such as urethane rubber, so as to be transported to a transfer position. In the transfer position, the toner image on the photosensitive drum having a negative charge is transferred to the print paper by the action of a positive charge applied on the reverse side surface of the transfer belt by a corona charger. Therein, in a case where the print paper does not arrive at the transfer position due to a paper jam or where the print paper arrives and is passed through the transfer position in a partly folded state, the toner image on the photosensitive body is directly transferred to the surface of the transfer belt.

The reverse side surface of a following sheet of paper is spoiled unless the toner is completely cleaned. Further, since the tacking force between the print paper and the transfer belt is decreased, there arises a phenomenon in which the print paper wraps around the photosensitive drum after transferring the toner image (drum wrap). Therefore, it is absolutely necessary to improve the performance of the cleaning system for a transfer belt.

Incidentally, the different points of cleaning for a transfer belt from cleaning for a photosensitive body are as follows:

(1) the toner on a transfer belt is uniformly aligned with a negative polarity since the toner is a transferred toner, and (2) the positive charge given by a corona charger remains on the reverse side surface of the transfer belt.

Therefore, for cleaning a transfer belt, there is no need to provide means for aligning the charge polarity upstream of the bias cleaning system, as described in Japanese Patent Application Laid-Open No. 63-15278 (1988). On the other hand, when a negative charge applying means is provided, the adhesive force of the toner to the transfer belt becomes large, since the charged amount of the toner negatively increases significantly, which causes a decrease in the cleaning ability. Thus, the conventional approach is not suitable for a bias cleaning system for a transfer belt.

SUMMARY OF THE INVENTION

An object of the present invention is to provide a bias cleaning system forming a cleaning unit suitable for removing toner which has adhered to a member, such as a transfer belt, a transfer roller, an intermediate transfer body and so on, and to an electro-static printing apparatus therewith and an operating method thereof.

In order to attain the object of the present invention, a first feature is characterized by providing a bias cleaning system having an electrically conductive brush roller for collecting toner which has adhered on a toner carrying member by scrubbing the toner carrying member under a condition in which the member has a direct current voltage of the opposite polarity to the charge of the toner applied thereto, and a collecting roller for collecting the toner by contacting the electrically conductive brush roller under a condition in which the collecting roller has a direct current voltage of the same polarity as and higher voltage than the voltage applied to the electric conductive brush roller applied thereto, and which comprises toner charge decreasing means for decreasing the charged amount of the toner on the toner adhering member, for example, such as corona charger generating a charge of the opposite polarity to the charge of the toner, provided on an up-stream side of the electric conductive brush roller in the moving direction of the toner carrying member.

In order to attain the object of the present invention, a second feature is characterized by providing a bias cleaning system having an electrically conductive brush roller for collecting remaining toner on a toner carrying member by scrubbing the toner carrying member under a condition in which a direct current voltage of the opposite polarity to the charge of the toner is applied thereto, a collecting roller for collecting the toner by contacting the electrically conductive brush roller under a condition in which the collecting roller has a direct current voltage of the same polarity as and higher voltage than the voltage applied to the electrically conductive brush roller applied thereto, and an opposed roller placed in opposition to the electrically conductive brush roller through the toner carrying member, wherein a high resistivity coating film, for example, such as anodic oxide coating, enamel coating or ceramic coating, is formed on the part of the opposed roller lying off the toner carrying member to make direct contact with the electrically conductive brush roller.

In order to attain the object of the present invention, a third feature is characterized by providing an operating method for a bias cleaning system having an electrically conductive brush roller for collecting toner which adheres to a toner carrying member by scrubbing the toner carrying member under a condition in which a direct current voltage of the opposite polarity to the charge of the toner is applied thereto, and a collecting roller for collecting the toner by contacting the electrically conductive brush roller under a condition in which the collecting roller has a direct current voltage of the same polarity as and higher voltage than the voltage applied to the electric conductive brush roller applied thereto, wherein said brush roller and said collecting roller are moved under the condition of stopping the rotation of the toner carrying member toward the reverse direction of the moving direction before stopping of the toner carrying member.

In order to attain the object of the present invention, a fourth feature is characterized by providing an operating method for a bias cleaning system having an electrically conductive brush roller for collecting remaining toner on a toner carrying member by scrubbing the toner carrying member under a condition in which a direct current voltage of the opposite polarity to the charge of the toner is applied thereto, and a collecting roller for collecting the toner by contacting the electrically conductive brush roller under a condition in which the collecting roller has a direct current voltage of the same polarity as and higher voltage than the voltage applied to the electric conductive brush roller applied thereto, wherein said electrically conductive brush roller is supplied with the voltage after the starting of movement of the toner carrying member, the movement of the toner carrying member being stopped after turning off the voltage applied to the electrically conductive brush roller.

In order to attain the object of the present invention, a fifth feature is characterized by providing an operating method for a bias cleaning system having an electrically conductive brush roller for collecting remaining toner on a toner carrying member by scrubbing the toner carrying member under a condition in which a direct current voltage of the opposite polarity to the charge of the toner is applied thereto, and a collecting roller for collecting the toner by contacting the electrically conductive brush roller under a condition in which the collecting roller has a direct current voltage of the same polarity as and higher voltage than the voltage applied to the electrically conductive brush roller applied thereto, wherein said collecting roller is supplied with a voltage not before voltage is applied to said electrically conductive brush roller.

In order to attain the object of the present invention, a sixth feature is characterized by providing an operating method for a bias cleaning system having an electrically conductive brush roller for collecting remaining toner on a toner carrying member by scrubbing the toner carrying member under a condition in which a direct current voltage of the opposite polarity to the charge of the toner is applied thereto, and a collecting roller for collecting the toner by contacting the electrically conductive brush roller under a condition in which the collecting roller has a direct current voltage of the same polarity as and higher voltage than the voltage applied to the electrically conductive brush roller applied thereto, wherein the voltages applied to the electrically conductive brush roller and the collecting roller are increased step by step, for example, in a step-wise manner corresponding to an increase in the number of printed sheets.

In order to attain the object of the present invention, a seventh feature is characterized by providing an operating method for a bias cleaning system having an electrically conductive brush roller for collecting remaining toner on a toner carrying member of scrubbing the toner carrying member under a condition in which a direct current voltage of the opposite polarity to the charge of the toner is applied thereto, a collecting roller for collecting the toner by contacting the electrically conductive brush roller under a condition in which the collecting roller has a direct current voltage of the same polarity as and higher voltage than the voltage applied to the electrically conductive brush roller applied thereto, and an opposed roller placed in opposition to the electrically conductive brush roller through the toner carrying member, wherein the voltage applied to the opposed roller is decreased step by step corresponding with an increase in the number of printed sheets.

In order to attain the object of the present invention, a eighth feature is characterized by providing an electrostatic printing apparatus using a belt transfer system for transferring a toner image on a photosensitive body to a print paper sheet by causing contact between the print paper sheet mounted on a transfer belt formed of a dielectric material and the photosensitive body and applying charge of the opposite polarity to the toner to the reverse side surface of the transfer belt, which comprises an electrically conductive brush roller for collecting remaining toner which has adhered on a transfer belt by scrubbing the toner carrying member under a condition in which a direct current voltage of the opposite polarity to the charge of the toner is applied thereto, a collecting roller for collecting the toner by contacting the electrically conductive brush roller under a condition in which the collecting roller has a direct current voltage of the same polarity as and higher voltage than the voltage applied to the electrically conductive brush roller applied thereto, and toner charge decreasing means for decreasing the amount of charge on the toner carrying member provided on an up-stream side of the electrically conductive brush roller in the moving direction of the toner carrying member.

In order to attain the object of the present invention, a ninth feature is characterized by providing an electrostatic printing apparatus of intermediate transfer body type for effecting contact between an intermediate transfer body made of a dielectric material and a photosensitive body having a toner image formed thereon, transferring the toner image on the photosensitive body to the intermediate transfer body, and transferring the toner image from the intermediate transfer body to a print paper sheet, which comprises an electrically conductive brush roller for collecting remaining toner which has adhered on the intermediate transfer body by scrubbing the intermediate transfer body under a condition in which a direct current voltage of the opposite polarity to the charge of the toner is applied thereto, a collecting roller for collecting the toner by contacting the electrically conductive brush roller under a condition in which the collecting roller has a direct current voltage of the same polarity as and higher voltage than the voltage applied to the electrically conductive brush roller applied thereto, and toner charge decreasing means, such as a corona charger for generating a charge of the opposite polarity to the charge of toner, for example, for decreasing the amount of charge on the toner on the intermediate transfer body provided on an upstream side of the electrically conductive brush roller in the moving direction of the intermediate transfer body.

For the bias cleaning system, it is required to optimize the parameters affecting the cleaning ability for the transfer belt (for example, the charged amount of toner, the resistivity of the brush, the voltage applied to the brush and so on).

In accordance with the first, the eighth and the ninth features according to the present invention, as described above, the charged amount of toner can be optimized and a high cleaning efficiency can be attained, since the charged amount of the toner which has adhered on the toner carrying member is decreased using charge decreasing means.

In accordance with the second feature, the leakage current between the electrically conductive brush roller and the opposed roller can be decreased to prevent the spacial electric field from weakening, since a high resistivity coating film which is formed on the part of the opposed roller lying off the toner carrying member and which directly contacts the electrically conductive brush roller.

In accordance with the third feature, the toner and/or paper flakes building up in the electrically conductive brush roller can be removed and a high cleaning efficiency can be maintained by moving the brush roller and the collecting roller while stopping the rotation of the toner carrying member in the reverse direction to the moving direction before stopping of the toner carrying member.

In accordance with the fourth feature, a degradation of the cleaning performance can be prevented, since the charge flow from the electrically conductive brush roller to the toner carrying member is decreased.

In accordance with the fifth feature, damage in the electrically conductive brush roller can be suppressed, since a rise in voltage difference between the electrically conductive brush roller and the collecting roller can be prevented.

In accordance with the sixth and the seventh features, high cleaning efficiency can be maintained since a decrease in the strength of the electric field in the gap due to an increase in the number of printed sheets can be prevented.

DETAILED DESCRIPTION OF THE PREFERRED EMBODIMENTS

Figure 1:
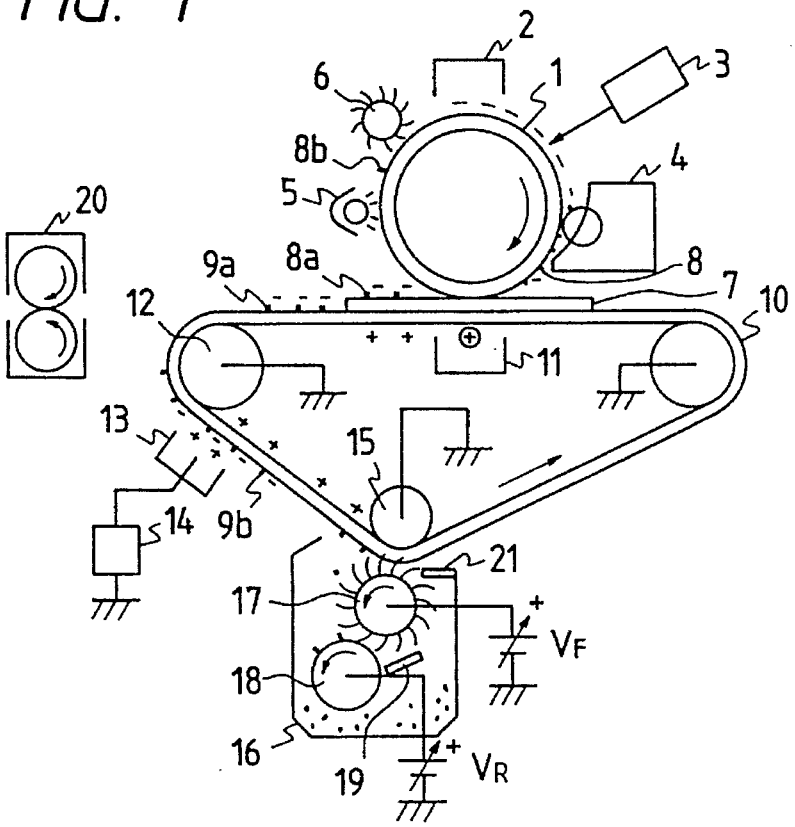
FIG. 1 is a schematic diagram showing the construction of a main part of an electro-static printing apparatus relating to an embodiment in accordance with the present invention.

First, the basic operation of a cleaning mechanism in a bias cleaning system in accordance with the present invention will be explained with reference to FIG. 2.

A transfer belt 10 is disposed between an opposed roller 15 and an electrically conductive brush roller 17, and a brush voltage $V_F$ is applied between the opposed roller 15 and the electrically conductive brush roller 17. Therewith, an electric field Ea is produced in the gap 22 between the top end of brush fiber 23 and the transfer belt 10.

A force of attraction F1 to the transfer belt 10 and a force of repulsion F2 from the transfer belt 10 act on toner 9*a*. The force of attraction F1 is composed of an electro-static force acting between the amount of charge Qt on the toner 9*a* and the positive charge on the reverse side surface of the belt 10 and an imaging force. The force of repulsion F2 is dependent on the electric field Ea and the amount of charge Qt. When the relation F2>F1 is satisfied, the toner is transported to the electrically conductive brush roller 17. Supposing the amount of charge on the toner is Qt. F1 and F2 are expressed as the following equations.

$$F1 \propto (Qt)^2$$

$$F2 \propto (Qt) \cdot Ea$$

Since F2>F1, Ea>Qt is derived.

Therefore, when the amount of charge Qt on the toner is small, the toner 9*a* on the transfer belt 10 can be transported to the brush fiber 23 with a weak electric field Ea in the gap. The transportation of the toner is a kind of transfer phenomenon which establishes a toner cleaning performance and depends on the electric field Ea in the gap.

Figure 3:
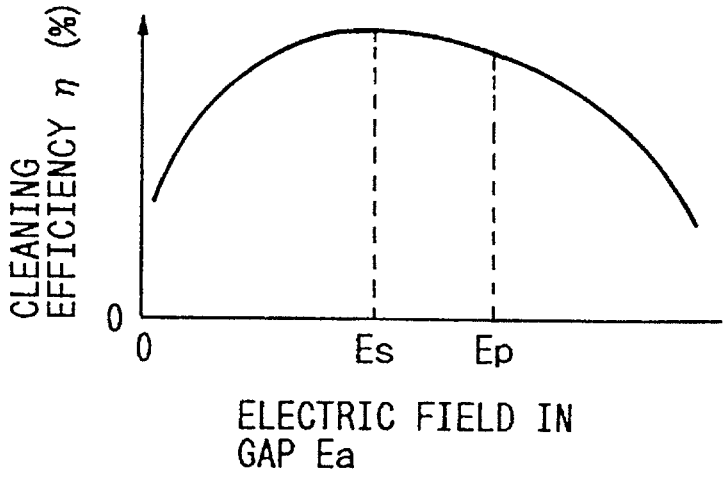
FIG. 3 is a characteristic diagram showing the relationship between an electric field in a gap and cleaning efficiency.

The feature is shown in FIG. 3 in which the electric field Ea is shown on the abscissa and the cleaning efficiency η is shown on the ordinate. As can be seen, Ea shows that an optimum value Es of the electric field (approximately 350 kV/cm) provides a maximum value of the cleaning efficiency. When the electric field Ea in the gap exceeds the value Es, discharge occurs in the gap resulting in a gradual decrease in the cleaning efficiency. Ep indicates the electric field value at the initiation of discharge.

Figure 4:
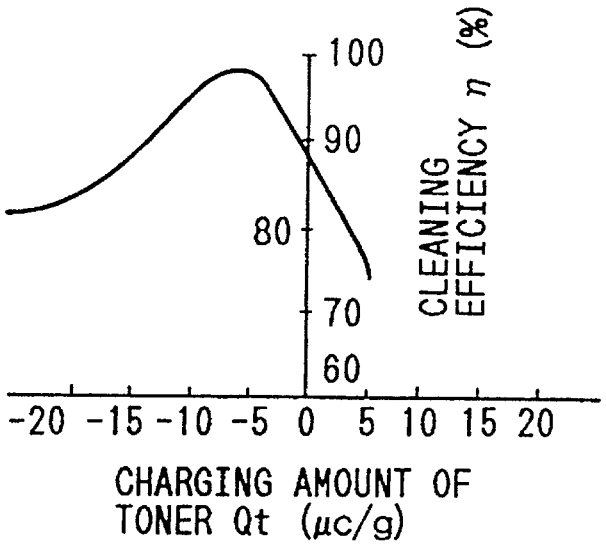
FIG. 4 is a characteristic diagram showing the relationship between a charged amount of toner and cleaning efficiency.

FIG. 4 shows the relationship between the cleaning characteristic (cleaning efficiency) of the remaining toner on a transfer belt and the amount of charge of the remaining toner obtained from an experiment using a bias cleaning system. The brush voltage was within the range of 600 V to 800 V. The amount of charge on the toner was measured with a well known Attraction Faraday Gage method.

The toner transfer efficiency depends on the amount of charge on the toner, having an optimum range and becoming at a maximum when the amount of charge is around −5 μC/g. When the amount of charge on the toner is zero or the toner is oppositely charged positive, the electrical force of attraction to the brush disappears, and as a result, the transfer efficiency substantially decreases. Therefore, it is necessary that the amount of charge on the toner be less than at least 0 μC/g and larger than −15 μC/g, and preferably less than −2 μC/g and larger than −10 μC/g.

Figure 5:
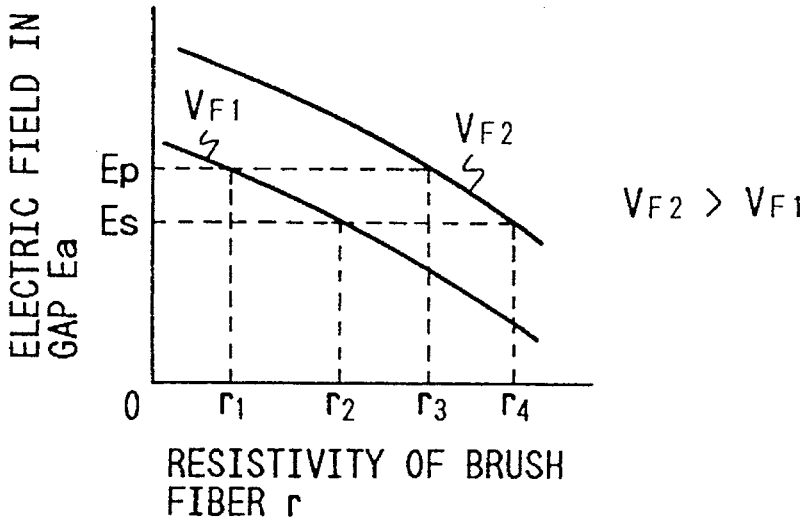
FIG. 5 is a characteristic diagram showing the relationship between resistivity of a brush fiber and electric field in gap with brush voltage as a parameter.
Figure 6:
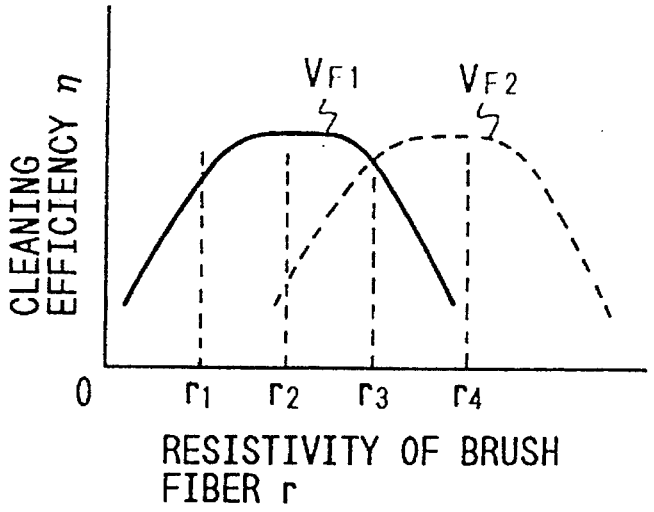
FIG. 6 is a characteristic diagram showing the relationship between resistivity of a brush fiber and cleaning efficiency with brush voltage as a parameter.

FIG. 5 shows the relationship between the resistivity of the brush fiber r and the electric field Ea in the gap. FIG. 6 shows the relationship between the resistivity of the brush fiber r and the cleaning efficiency η.

Here, the resistivity of the brush fiber r is an apparent resistivity, in that the resistivity of the brush fiber increases when toner coats the surface of the fiber. As shown in FIG. 5, the electric field Ea depends on the resistivity of brush fiber r and the brush voltage $V_F$. The relationship between the resistivity of the brush fiber r and the cleaning efficiency η in FIG. 6 is obtained from FIG. 3, which shows the relationship between the cleaning efficiency and the electric field in the gap, and from FIG. 5. The following items can be derived from FIG. 6.

(a) The resistivity of the brush fiber r has an optimum range, which is not too small and not too large, during which a high cleaning efficiency is obtained when the brush voltage $V_F$ is constant.

(b) By varying the value of the bias voltage $V_F$ corresponding to the change with elapsed time in the resistivity of the brush fiber, the cleaning efficiency can be kept to a maximum.

Figure 7:
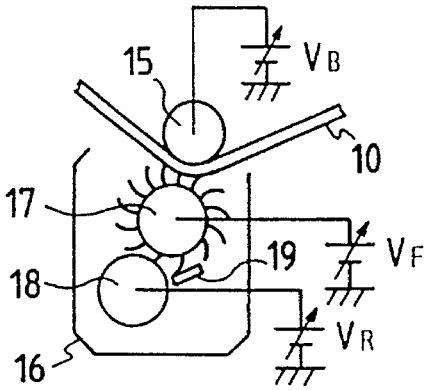
FIG. 7 is an diagrammatical view showing a state in which a bias voltage $V_B$ is applied to an opposed roller.
Figure 8:
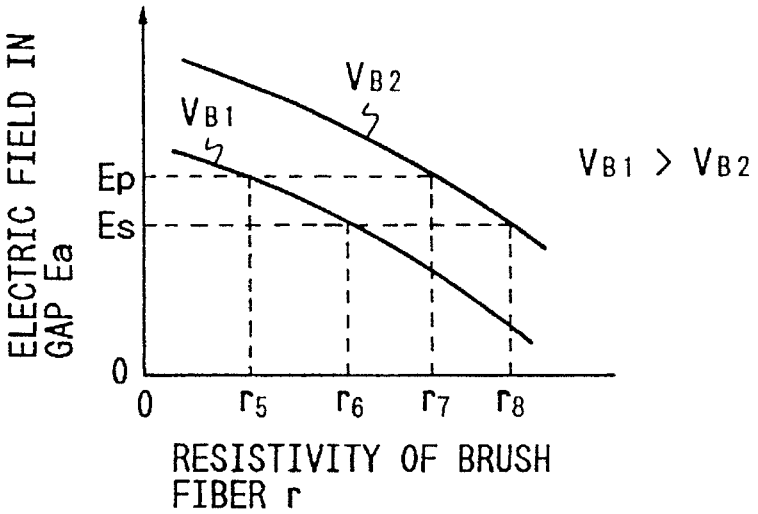
FIG. 8 is a characteristic diagram showing the relationship between resistivity of a brush fiber and the electric field in a gap with bias voltage as a parameter.
Figure 9:
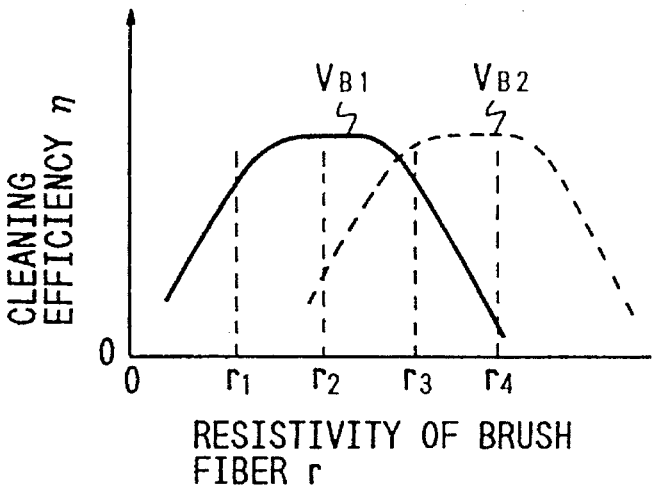
FIG. 9 is a characteristic diagram showing the relationship between resistivity of a brush fiber and cleaning efficiency with bias voltage as a parameter.

FIG. 8 and FIG. 9 show the cleaning characteristic when the bias voltage $V_B$ is applied to an opposed roller 15, as shown in FIG. 7.

The electric field Ea in the gap varies according to the bias voltage $V_B$ even when the brush voltage $V_F$ is constant. As the bias voltage $V_B$ decreases, the electric field Ea in the gap increases, as seen in FIG. 8. Therefore, by decreasing the bias voltage $V_B$ when the resistivity r of the brush fiber 23 increases, a high cleaning efficiency can be maintained.

From the above results, optimization in the amount of charge on the toner, optimization in the resistivity of the brush fiber, optimization in the brush voltage and the bias voltage applied to the opposed roller can be derived as follows.

(1) Optimization in the Amount of Charge on the Toner

By pre-treating the amount of charge on the toner remaining on a toner image carrying body, such as transfer belt, so as to become below 15 μC/g before the toner arrives at the bias cleaner, a high cleaning efficiency can be attained.

(2) Optimization in the Resistivity of the Brush Fiber

By choosing a suitable value for the resistivity of the brush fiber, a high cleaning efficiency can be attained.

(3) Optimization in the Brush Voltage and the Bias Voltage for the Opposed Roller By adjusting the brush voltage and the bias voltage for the opposed roller even when the resistivity of the brush changes with elapse of time, a high cleaning efficiency can be attained since the electrical field in the gap between the brush and the belt can be set to an optimum condition.

FIG. 1 is directed to an embodiment of the present invention which utilizes an inverse developing method using toner charged with a negative polarity, for example.

A photosensitive drum 1, which is negatively charged by a charger 2, is exposed by an exposing unit 3 using a laser or LED to form a latent image, and then a toner image 8 is formed on the photosensitive drum 1 by a developing unit 4. A print paper sheet 7 is caused to electro-statically adhere to a transfer belt 10 made of a dielectric material (single layer or plural layers), such as urethane rubber, so as to be transported to a transfer position. In the transfer position, the toner image 8*a*, having a negative charge on the photosensitive drum 1, is transferred to the print paper sheet 7 by the positive charge given on the reverse side surface of the transfer belt 10 by a transfer corotron 11.

On this occasion, in a case where the print paper sheet 7 does not arrive at the transfer position due to a paper jam, or where the print paper sheet 7 arrives at and is passed through the transfer position in a partly folded state, the toner image or a part thereof on the photosensitive drum 1 is directly transferred to the surface of the transfer belt 10. The toner transferred to the transfer belt 10 is indicated by the reference symbol *9a*. The numeral 13 indicates a corotron for discharging the charge on the toner *9a*, and the numeral 14 indicates a positive voltage direct current power source. The numerals 17, 18 and 15 are an electrically conductive brush roller, a collecting roller and an opposed roller, respectively.

The electrically conductive brush roller 17 is rotated with a rotating speed of 88 rpm, and the collecting roller 18 is rotated with a rotating speed of 133 rpm. The toner *9b* discharged by the corotron 13 is electrically and mechanically scrubbed from the transfer belt 10 by the electrically conductive brush roller 17, to which is applied a positive direct current voltage of 600 V, and is further transferred to the collecting roller 18, to which a positive direct current voltage of 900 V is applied. The collecting roller 18 is then scrubbed with a collecting roller blade 19 so that removed toner is accumulated in a cleaner unit 19 (container).

Here, the numeral 5 indicates a discharge lamp, and the numeral 6 indicates a brush cleaner. The numeral *8b* indicates remaining toner, the numeral 12 represents a drive roller, the numeral 20 indicates a fixing unit, and the numeral 21 represents a brush blade.

Figure 10:
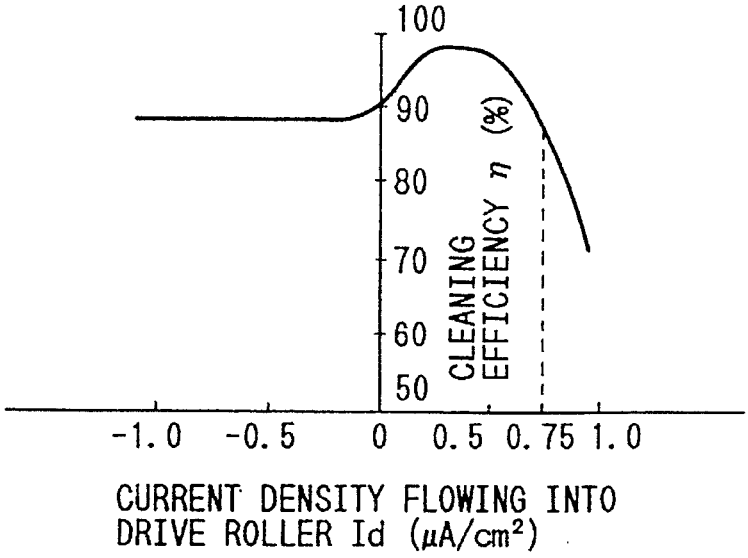
FIG. 10 is a characteristic diagram showing the relationship between current density flowing into a drive roller and cleaning efficiency.

FIG. 10 is a characteristic diagram showing the relationship between current density Id flowing from the corotron 13 into the drive roller 12 for the transfer belt 10 and the cleaning efficiency $\eta$.

When the current density Id is 0 $\mu A/cm^2$, the amount of charge Qt on the toner is $\mu C/g$ and the cleaning efficiency is 90%. As the positive current is increased, the cleaning efficiency increases and becomes 98% in the range of current densities of 0.25–0.5 $\mu A/cm^2$. As the positive current is further increased, on the other hand, the cleaning efficiency decreases. The cleaning efficiency becomes 90% when the amount of charge Qt on the toner is 0.75 $\mu A/cm^2$. And, as the amount of charge on the toner is further increased, the cleaning efficiency substantially decreases. Although the cleaning efficiency is measured with a flowing negative current, the cleaning efficiency does not exceed 90%.

In the range of the current densities Id of 0.25–0.5 $\mu A/cm^2$, the amount of charge Qt on the toner becomes from o to 15 $\mu C/g$. As described above, it is confirmed that the cleaning efficiency can be increased significantly up to 95% by providing means for decreasing the charge on the toner in the up-stream section of the cleaner unit 16.

The manner of effecting discharging for decreasing the charge on the toner is not limited to a direct current corona discharger, as shown in FIG. 1, but may take the form of an AC corona discharger or an AC discharger having superposed direct current. In a case where the toner charged positively, it is required to apply a negative charge to the toner, which can be performed by employing a negative corona discharger or an AC corona discharger. In addition to this, it is better to place the corotron 13 apart from the vicinity of the print paper transport passage to prevent contamination of the corotron by toner entering the inside of the corotron 13.

The cleaning efficiency also depends on the resistivity of the brush fiber 23, as shown in FIG. 6. However, from a cleaning performance point of view, the resistivity of the brush 17 involves not only the resistivity of the brush fiber 23 itself, but also involves a resistivity determined by planting the density of the fiber, and the scrubbing area between the collecting roller and the brush roller. On the other hand, the resistivity of the electrically conductive fiber itself changes depending on the voltage applied to the brush.

Accordingly, a plurality of brush rollers 17 have been produced for the purpose of conducting tests. The different brush rollers were made to have different resistivity of the electrically conductive brush fiber in the range of the planting densities of the fiber in the electrically conductive brush from 40 thousands/inch$^2$ to 100 thousands/inch$^2$. And, the scrubbing depth between the electrically conductive brush roller 17 and the collecting roller 18 is set to 1 mm (the scrubbing area with the collecting roller 18: 22 cm$^2$). The resistivity is measured while applying a voltage of 300 V between the electrically conductive brush roller 17 and the collecting roller 18 and while rotating the electrically conductive brush roller 17 and the collecting roller 18.

The region of the resistivity having a cleaning efficiency above 90% is surveyed by attaching the brushes of different resistivity to the cleaner unit 16 shown in FIG. 1 under a condition in which a brush voltage of 800 V and an applied voltage to the collecting roller of 1100 V is utilized.

Figure 11:
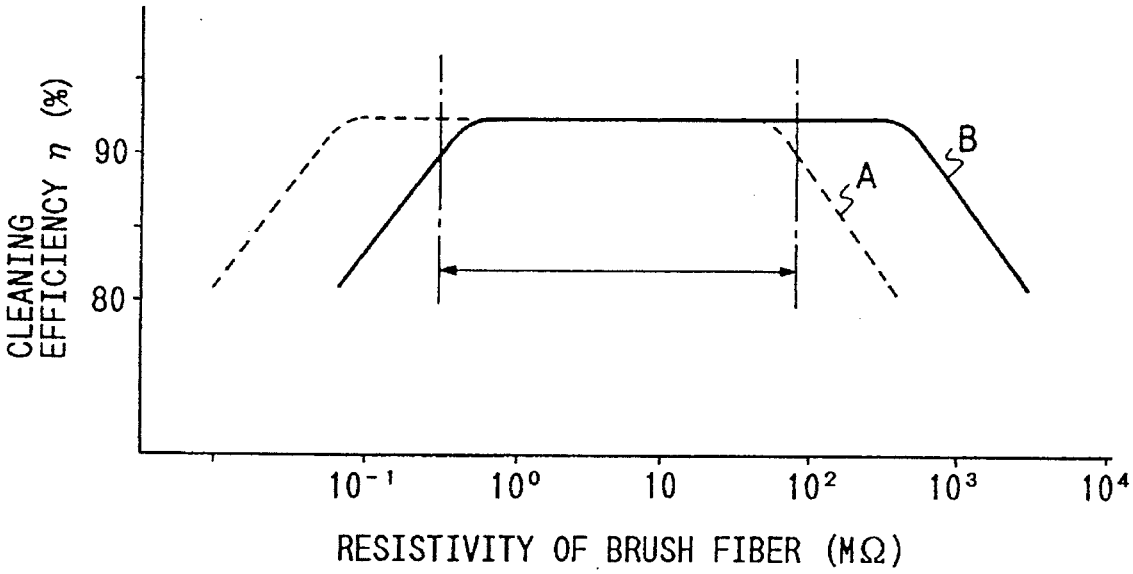
FIG. 11 is a characteristic diagram showing the relationship between resistivity of a brush fiber and cleaning efficiency.

FIG. 11 shows the result. In the figure, the curve A is for electrically conductive brush having a planting density of the fiber of 40 thousands/inch$^2$, and the curve B is for an electrically conductive brush having a planting density of 100 thousands/inch$^2$. Although there is a slight difference depending on the planting density of the fiber in the electrically conductive brush, the cleaning efficiency for each of the planting densities is above 90% so long as the resistivity of the electrically conductive brush fiber is between 0.2 to 90 M$\Omega$. If one designates the voltage applied to the electrically conductive brush roller 17 as $V_F$, the voltage applied to the collecting roller 18 as $V_R$, and the contact area between the electrically conductive brush roller and the collecting roller as Sr, the brush resistivity per unit area can be calculated from the resistivity of the electrically conductive brush roller measured by applying a voltage of $(V_R-V_F)$ between the electrically conductive brush roller 17 and the collecting roller 18 and the contact area Sr. Such a calculation reveals that the brush resistivity per unit area is within the range from $10^{-2}$ M$\Omega$/cm$^2$ to 4M$\Omega$/cm$^2$ when the resistivity of the electrically conductive brush fiber is within the range from 0.2 to 90 M$\Omega$.

In a long period of operation, it is found that the resistivity increases by two to three times the initial value after printing of one million pages, since toner and paper particles are accumulated inside the brush. Therefore, it is preferable that the brush resistivity is between $5\times10^{-2}$ M$\Omega$/cm$^2$ and 2 M$\Omega$/cm$^2$. By specifying the brush resistivity in such a manner, an extremely high cleaning efficiency can be obtained for a long period of operation.

Figure 12:
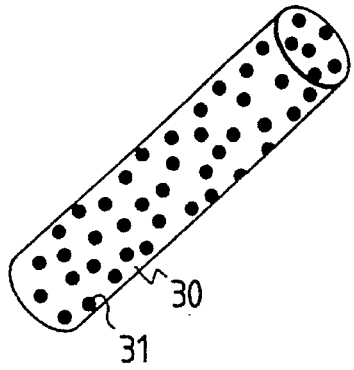
FIG. 12 is a partially enlarged perspective view showing an embodiment of a low resistivity fiber of the type used in the present invention.

Although a conventional brush has a brush resistivity of $10^2$ to $10^3$ M$\Omega$ the resistivity of the electrically conductive brush fiber in the present invention is relatively low, the resistivity being from 0.2 to 90 M$\Omega$. As an electrically conductive brush fiber having a low resistivity is used, a complex fiber is formed, for example, as shown in FIG. 12, by uniformly dispersing and holding electrically conductive fine particles 31, such as ultra fine particles of carbon black, in the fiber 30, such as a rayon fiber or polyamide fiber.

Figure 13:
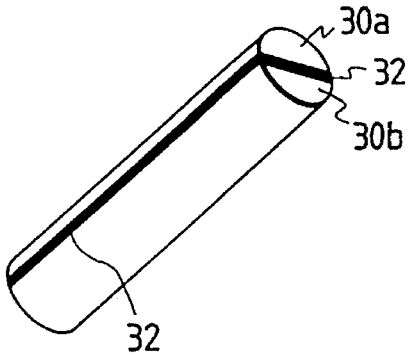
FIG. 13 is a partially enlarged perspective view showing another embodiment of a low resistivity fiber of the type used in the present invention.

It is also possible to use a complex fiber which is formed by putting an electrically conductive layer 32, such as carbon black, between semi-cylindrical fiber portions *30a* and 30*b*, such as a rayon fiber or polyamide fiber, in the longitudinal direction of the fiber, as shown in FIG. 13.

Figure 14:
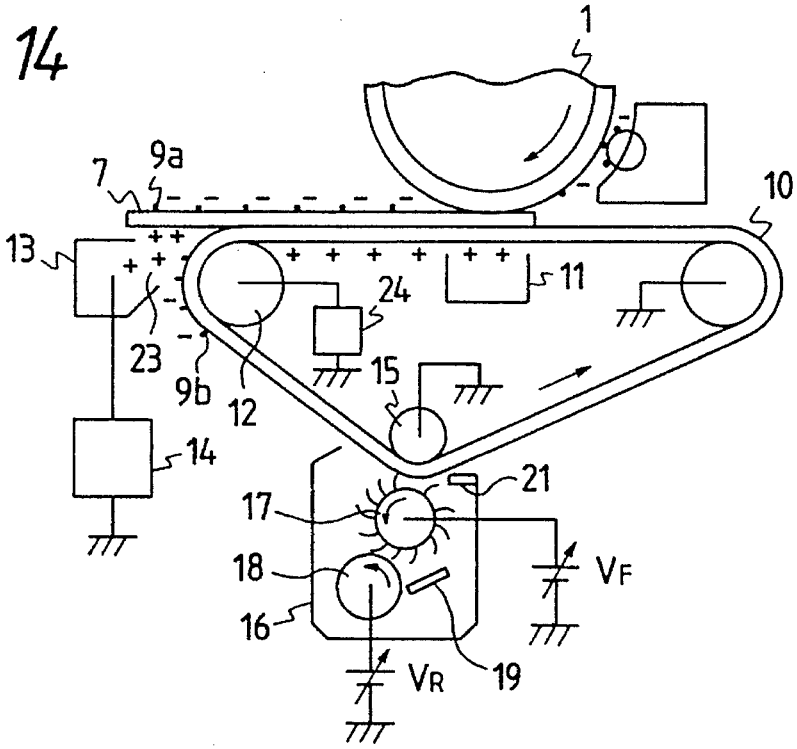
FIG. 14 is a schematic diagram showing the construction of a main part of an electro-static printing apparatus relating to an embodiment in accordance with the present invention.

FIG. 14 is a view showing an electrostatic printing apparatus having a function to supply a charge to the reverse side of print paper 7 using a corotron 13, which also serves to decrease the amount of charge on the toner remaining on a transfer belt 10.

The toner 9*a* on the print paper 7 is attracted to the print paper 7 by Coulomb force from the positive charge on the reverse side of a transfer belt 10 when the print paper 7 is carried on the transfer belt 10. However, when the print paper is removed from the transfer belt 10, there arises a phenomenon where the toner is discharged from the print paper 7, since the Coulomb force acting on the toner disappears. Therefore, a corotron 13 is provided near a drive roller 12, and a power source 14 supplies to the corotron 13 a positive direct current, the shape of the opening of the corotron 13 being formed such that a positive corona charge can be supplied both to the reverse side surface of the paper 7 and to the transfer belt 10.

By doing this, the toner 9*a* on the print paper 7 is attracted to the print paper 7 by Coulomb force from the positive charge on the reverse side of the print paper and is prevented from being discharged from the paper since the positive charge is maintained on the reverse side of the print paper 7.

By connecting a power source 24 to the drive roller 12 to apply a positive voltage to the drive roller 12, the toner is prevented from being discharged at least during the time the print paper passes the roller 12.

Although toner is apt to enter into the corotron 13, it is possible to prevent the toner from entering the corotron and attaching to a wire in the corotron by, for example, blowing air along the wire in the corotron 13. Further, it is possible that an AC power source may be employed as the power source 14 for the corotron 13.

The electrically conductive brush roller 17 scrubs the toner by rotating in contact with the transfer belt 10. However, the brush resistivity is gradually increased during a long term operation due to filming of the surface of the brush fiber 23 with toner.

Figure 2:
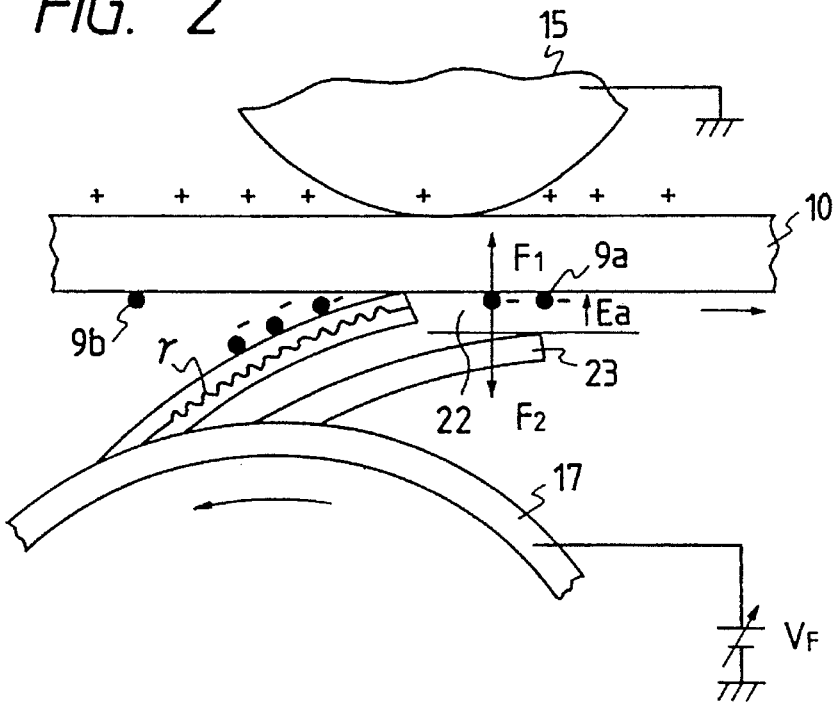
FIG. 2 is a diagrammatic view showing the cleaning mechanism in a bias cleaning system in accordance with the present invention.
Figure 15:
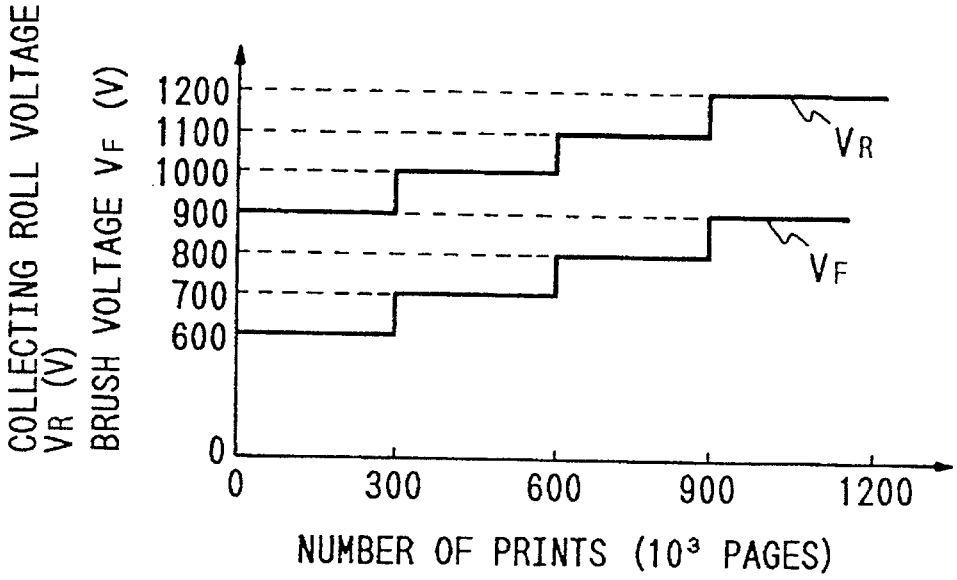
FIG. 15 is an explanatory diagram showing a type of control for brush voltage and collecting roller voltage.
Figure 16:
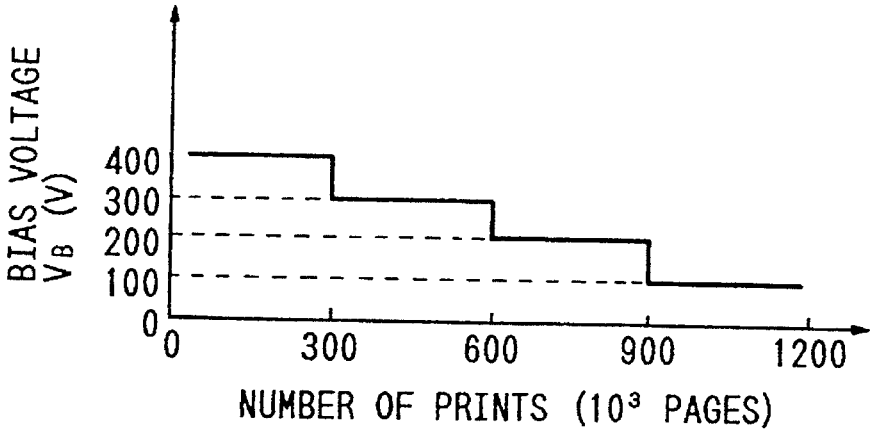
FIG. 16 is an explanatory diagram showing a type of control for bias voltage.

By increasing the brush voltage corresponding to the number of printed pages, as shown in FIG. 15, the electric field in the gap between the brush fiber 23 and the transfer belt 10 shown in FIG. 2 is prevented from decreasing, and an optimum electric field can be maintained.

Initially, the brush voltage $V_F$ is set in 600 V and the collecting roller voltage $V_R$ is set in 900 V, and then the brush voltage $V_F$ and the collecting roller voltage $V_R$ are step-wisely increased by 100 V for every 300 thousand print pages. As a result, the initial cleaning efficiency of 90% can be maintained up to one million and 200 thousand pages.

Here, the method can be applied to all bias cleaning systems, regardless of the kinds of objects to be cleaned, such as a photosensitive body, a dielectric belt, an intermediate transfer body, and combinations thereof, regardless of the presence/absence of toner charge decreasing means.

In foregoing discussion, the brush voltage $V_F$ and the collecting roller voltage $V_R$ were varied corresponding to the number of printed pages. On the other hand, the brush voltage $V_F$ and the collecting roller voltage $V_R$ may be kept constant, and a direct current bias voltage $V_B$ may be applied to the opposed roller 15 and varied corresponding to the number of printed pages. Therewith, the electrical field in the gap between the brush fiber 23 and the transfer belt 10 shown in FIG. 2 can be prevented from decreasing and an optimum electric field can be maintained. In such case, a brush voltage $V_F$ of 900 V and a collecting roller voltage $V_R$ of 1200 V are kept constant.

The direct current bias voltage $V_B$ is initially set at 400 V, and $V_B$ is step-wisely decreased every 300 thousand printed pages. As a result, a cleaning efficiency of 90% can be maintained up to one million and 200 thousand pages.

Here, the method can be applied to all bias cleaning systems, regardless of the kinds of objects to be cleaned, such as a photosensitive body, a dielectric belt, an intermediate transfer body, and combinations thereof, regardless of the presence/absence of toner charge decreasing means.

Because the electrically conductive brush roller 17 scrubs the toner by rotating in contact with the transfer belt 10, it is found that the brush resistivity is not only apparently increased by long term operation due to filming of the surface of the brush fiber 23 with toner, but the scrubbing area of the transfer belt 10 is decreased due to the decreasing diameter of the brush roller 17 caused by the bending of the fibers. Especially, when toner is accumulated in the brush, the fibers are apt to be bent.

Therefore, at times other than when a printing operation is being carried out, the transfer belt 10 is stopped and the electrically conductive brush roller 17 and the collecting roller 18 each are rotated in the opposite direction to the normal rotating direction for several seconds. By employing this process, any toner which has accumulated on the electrically conductive brush roller 17 is removed.

On this occasion, in order to prevent the toner which is discharged from the electrically conductive brush roller 17 from re-attaching to the transfer belt 10, a shielding plate 21 formed of a plastic film, such as a polyester film, is provided between the electrically conductive brush roller 17 and the transfer belt 10 (refer to FIG. 1). In addition to this, after the rotation of the rollers 17 and 18 in the opposite direction, the electrically conductive brush roller 17 and the collecting roller 18 are returned to rotation in the normal direction and the toner scattered onto the transfer belt 10 is removed while the transfer belt 10 is being rotated.

It is also possible to improve the removing efficiency of the toner accumulating in the brush roller 17 by providing a toner beating rod, which is not shown in the figure, near the brush roller 17.

For a brush material which is less susceptible of producing a bending of the fibers, a fiber of the rayon group is preferable to a fiber of the polyamide group. As another method of preventing a decrease in the cleaning efficiency due to fiber bending, there is a method where the scrubbing area between the brush fiber 23 and the transfer belt 10 is maintained by shortening the distance between the shaft of the brush roller 17 and the transfer belt 10 as the number of the printed pages increases.

Here, the method can be applied to all bias cleaning systems, regardless of the kinds of objects to be cleaned, such as a photosensitive body, a dielectric belt, an intermediate transfer body, and combinations thereof, regardless of the presence/absence of toner charge decreasing means.

In a case where a brush having a relatively low resistivity is employed, when a voltage $V_F$ is applied to the electrically conductive brush roller 17 in the cleaner unit in FIG. 1 during a state of stopping of the transfer belt 10, a positive charge flows from the positively charged brush fiber into the negatively charged toner. It is found that when the transfer belt 10 is stopped for a long time or the brush voltage is high, the amount of charge which flows increases to cause the toner to charge in the opposite polarity, which leads to a bad effect in cleaning.

To solve this problem, the brush voltage $V_F$ is applied after the transfer belt 10 is started to move, and the transfer belt 10 is stopped after the brush voltage $V_F$ is turned off. By doing this, the cleaning efficiency can be prevented from decreasing.

The voltage $V_R$ applied to the collecting roller 18 is higher than the voltage $V_F$ applied to the brush roller 17. When a voltage is applied first to the collecting roller 18, the voltage difference between the brush roller 17 and the collecting roller 18 becomes large and the current flowing to the brush fiber 23 is increased to cause damage to the brush.

The way to apply voltage to the brush roller 17 and the collecting roller 18 in the cleaner unit is determined so that the voltage is applied to the collecting roller 18 after the voltage is applied to the brush roller 17, or the voltages are applied to the rollers at the same time. By doing this, the voltage difference between the brush roller 17 and the collecting roller 18 is prevented from rising.

Figure 17:
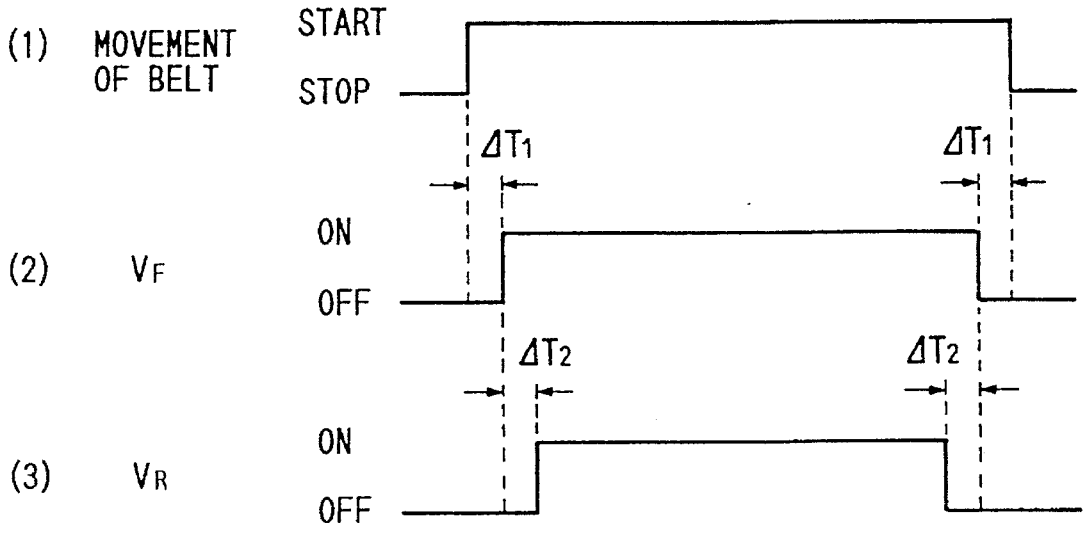
FIG. 17 is a timing chart showing each of the operations of starting/stopping of movement of a transfer belt, turning ON/OFF of a brush voltage $V_B$ and turning ON/OFF of a collecting roller voltage $V_R$.

FIG. 17 is a timing chart concerning starting/stopping of movement of the transfer belt 10, turning on/off of the brush voltage $V_F$ and turning on/off of the collecting roller voltage $V_R$. It is preferable that the time difference $\Delta t$ between each of operations is 50–200 milli-seconds.

Here, the method can be applied to all bias cleaning systems, regardless of the kinds of objects to be cleaned, such as a photosensitive body, a dielectric belt, an intermediate transfer body, and combinations thereof regardless of the presence/absence of toner charge decreasing means.

In a case where a transporting problem, such as jamming of the print paper 7 at a pick portion or wrapping of the print paper 7 around the photosensitive drum 1 occurs, the following sequence is carried out.

(1) The apparatus is stopped to remove the trouble, such as a paper jam, by retracting (detaching) the transfer belt 10 from the photosensitive drum 1.

(2) When the print paper 7 causes a jam upstream of the transfer position, a toner image on the transfer drum 1 is transferred to the transfer belt 10. Therefore, while the transfer belt 10 in a retracting state is being rotated several times without printing, the toner on the transfer belt 10 is cleaned using the bias cleaner. On this occasion, the operation of the transfer corotron 11 is stopped.

(3) The transfer belt 10 and the photosensitive drum 1 are placed in contact with each other, and then the photosensitive drum 1 and the transfer belt 10 are rotated for several seconds to prepare for printing. Therein, at the photosensitive drum 1 side, the charger 2, the discharge lamp 5 and the brush cleaner 6 are operated. And, at the transfer belt 10 side, the transfer corotron 11, the corotron 13 and the bias cleaner are operated. On this occasion, the amount of charge on the toner is decreased by the corotron 13.

Figure 18:
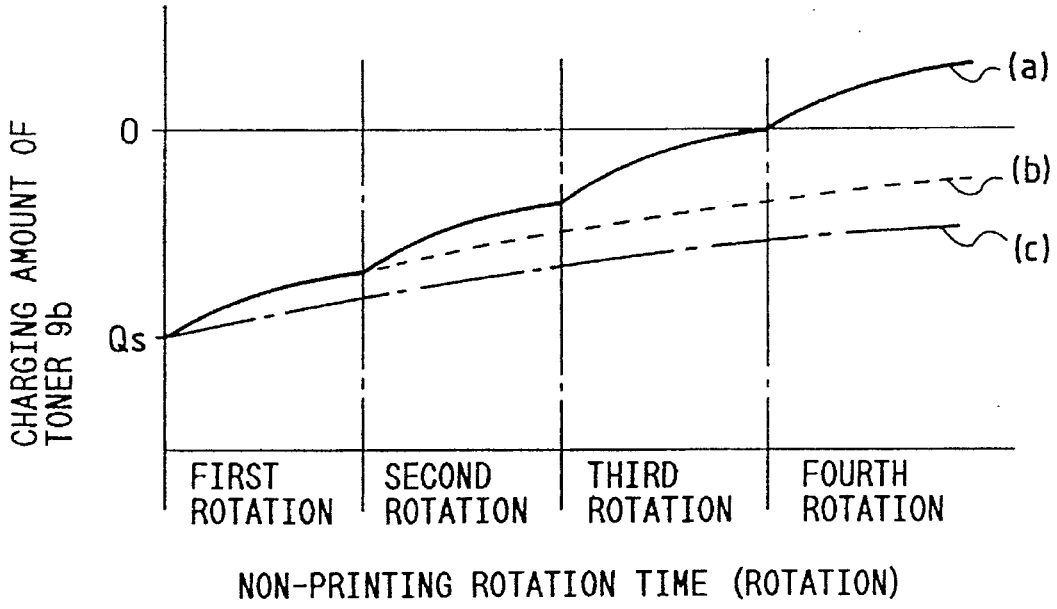
FIG. 18 is an explanatory diagram showing a change in amount of charge on toner during a reset non-printing rotation time.

FIG. 18 shows change in the amount of charge on the toner with the current density Id flowing into the drive roller as a parameter. The curve (a) in FIG. 18 shows a case where the current density is the same as the discharging current (Id=0.5 $\mu A/c^2$) in the normal paper passing time. The amount of charge on the toner is being decreased as the time passes, and in the fourth rotation the polarity of the toner charge is reversed. As a result, cleaning cannot be performed.

Figure 19:
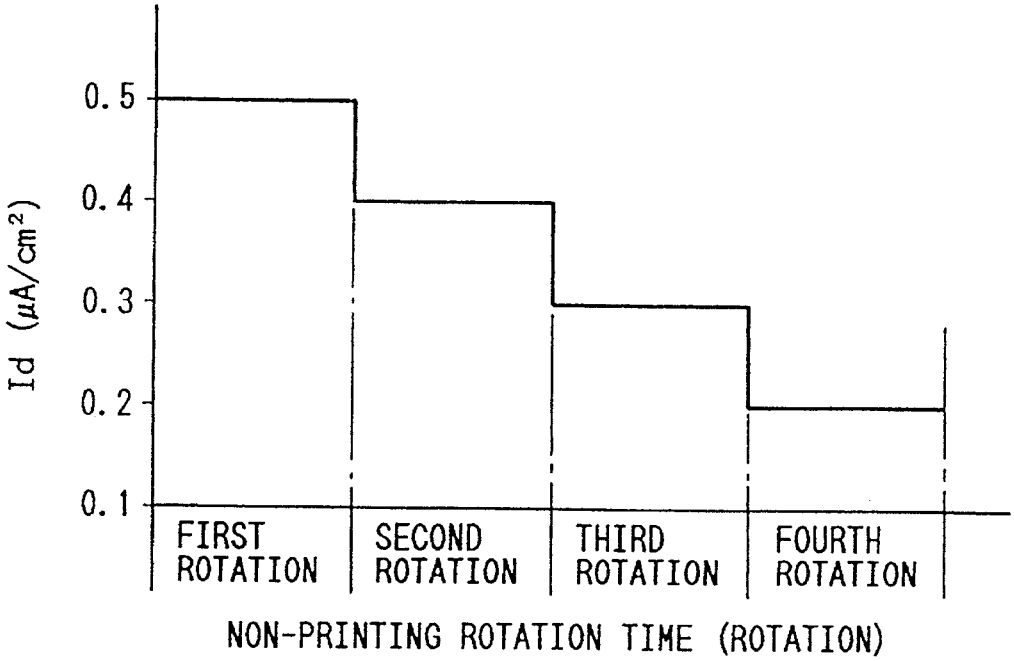
FIG. 19 is a graph showing the relationship between current density flowing to a drive roller and the number of rotations during a reset non-printing rotation time.

The current of the power source 14 for the corotron 13 is decreased in step-wise as shown in FIG. 19 in such a manner that the current of the power source in the second rotation is decreased to a value (for example, Id=0.4 $\mu A/cm^2$) smaller than that in the first rotation, the current in the third rotation (for example, Id=0.3uA/$cm^2$) being smaller than that in the second rotation, the current in the fourth rotation (for example, Id=0.2 uA/$cm^2$) being smaller than that in the third rotation. By doing this, the polarity of the toner charge is prevented from reversing during non-printing cleaning time as shown by the curve (b) in FIG. 18.

The curve (c) in FIG. 18 shows a case where the power source 14 for the corotron 13 is switched off (Id=0 $\mu A/cm^2$). The same effect as above can be obtained when the rotation time is long, since the toner charge is gradually decreased.

By means of changing the operating condition at belt retracting time of the corotron 13 (toner charge decreasing means) from the operating condition at normal operation, an optimum cleaning performance can be kept in each of the cases described above.

Although the descriptions of various features have been made in which the transfer belt 10 operates as a toner carrying member, the present invention can be applied to cleaning of an intermediate transfer body. Explanation here will be made of a case where an inverse developing method using toner charged with a negative polarity is employed.

Figure 20:
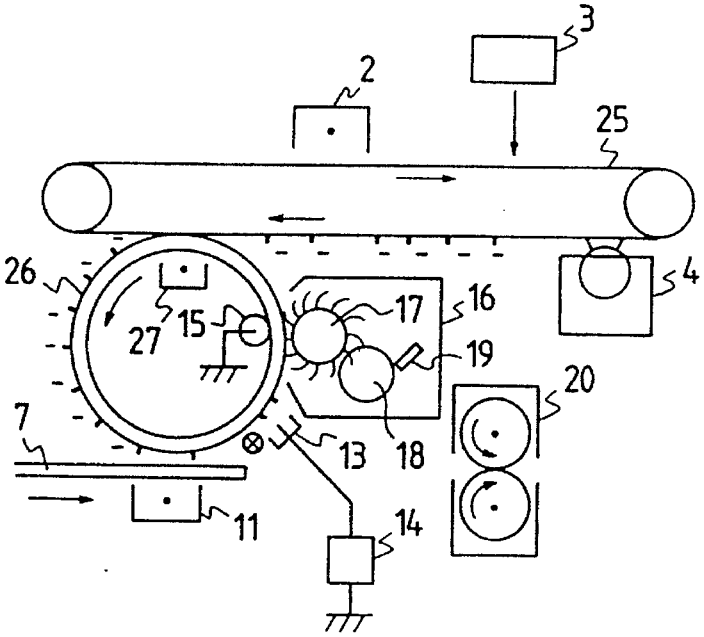
FIG. 20 is a schematic diagram showing the construction of a main part of an electro-static printing apparatus relating to an embodiment in accordance with the present invention.

FIG. 20 shows an electro-static printing apparatus utilizing an intermediate transfer drum 26. A photosensitive belt 25 negatively charged by a charger 2 is exposed with an exposing unit 3 using a laser or LED to form a latent image, then a toner image 8 is formed on the photosensitive drum 1 using a developing unit 4. The toner image is transferred to the intermediate transfer drum 26.

The intermediate transfer drum 26 is, generally, formed by wrapping a dielectric film, such as a polyester film, around a supporting body in a drum-shape, and the toner image is transferred to the surface of the intermediate transfer drum 26 by the action of the positive charge supplied to the reverse side surface of the dielectric film by the transfer corotron 27.

In color printing, four developing units, one for cyanine, one for magenta, one for yellow and one for black, are provided, and a multi/full color image is formed on the intermediate transfer drum 26 during four rotations of the photosensitive belt 25 and the intermediate transfer drum 26. Then, the toner image is transferred from the intermediate transfer drum 26 to print paper 7 and is fixed with a fixing unit 20.

The charge on the toner transferred to the intermediate transfer drum 26 is negative as is the transfer belt 10.

In a case where a bias cleaning system is used for cleaning, an extremely high cleaning efficiency can be obtained by providing a corotron 13 generating a positive charge to act as a toner charge decreasing unit on the upstream side of the cleaning unit 16.

The control (brush roller voltage control, opposed roller voltage control) described previously may be also applied to this case.

In a case where a transporting problem, such as jamming of the print paper 7 at a pick-up portion (which is not shown in the figure) or wrapping of the print paper 7 around the intermediate transfer drum 26 occurs, the printing operation is stopped. After removing the print paper, in order to clean the toner remaining on the intermediate transfer drum 26, the bias cleaner is used while the intermediate transfer drum 26 is being rotated several times without printing. On this occasion, the amount of charge on the toner is decreased by the corotron 11 in such a manner that the current of the power source 14 is decreased in a step-wise manner, as shown in FIG. 19, or the power source 14 is stopped. By doing this, the polarity of the toner charge is prevented from reversing during a non-printing cleaning time.

In FIG. 1 and in FIG. 20, the electrically conductive brush roller 17 is disposed in a region adjacent the transfer belt 10 or the intermediate transfer drum 26. When the electrically conductive brush roller 17 contains a brush fiber 23 having a low resistance, a leakage of current is caused in this region.

Figure 21:
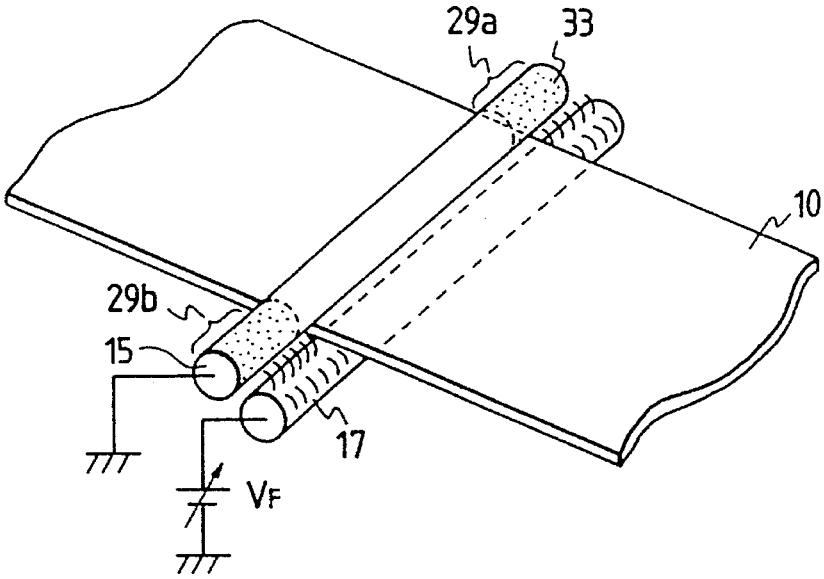
FIG. 21 is a diagrammatic view showing the construction of a main part of an electro-static printing apparatus relating to an embodiment in accordance with the present invention.

FIG. 21 shows the above-mentioned situation in a case of utilizing a transfer belt. The leakage of current can be prevented by forming a high resistivity coating film 33 in the regions 29*a* and 29*b* at the end portions of the opposed roller 15 to which the electrically conductive brush roller 17 directly contacts. An enamel film or a ceramic film is preferably used as the high resistivity coating film 33.

When an aluminum material is used for the opposed roller 15, an anodic oxide coating film may be formed on the surface as the coating film 33 by an anodic oxidation treatment of the surface. Here, the entire surface of the aluminum roller (the opposed roller 15) may be treated since the anodic oxide coating film is a semiconductor.

Here, this feature can be applied to all bias cleaning systems regardless of the kinds of objects to be cleaned, such as a photosensitive body, a dielectric belt, an intermediate transfer body, and combinations thereof, regardless of the presence/absence of a toner charge decreasing means.

An electro-static printing apparatus including the various features described above according to the present invention will be described with reference to FIG. 22 through FIG. 27. Therein, identical or like parts in each of the figures are identified by the same reference character as in the embodiments described above, and redundant descriptions will be omitted.

The numeral 34 identifies a brush roller power source capable of providing a varying magnitude of output voltage $V_F$ corresponding to a given digital control signal; the numeral 35 represents a collecting roller power source capable of providing a varying magnitude of output voltage $V_R$ corresponding to a given digital control signal; and the numeral 36 indicates an opposed roller power source capable of providing a varying magnitude of output voltage $V_B$ corresponding to a given digital control signal. Each of the digital signals which control the power sources 34, 35 and 36 is generated by a control unit 37.

The numerals 38*a* and 38*b* represent registration rollers which control the supply and timing of supply of a print paper sheet 7 to the transfer belt 10 where a toner image is transferred thereon. The numeral 39 identifies a print paper counting sensor which detects the print paper 7 as it is supplied to the transfer belt 10 by the registration rollers 38*a* and 38*b* and outputs a detected paper signal.

The numeral 40 identifies a belt drive motor for rotating a drive roller 12 over which the transfer belt 10 passes, and the belt drive motor 40 is powered by a belt drive motor power source 41 controlled by the control signal output from the control unit 37.

Figure 23:
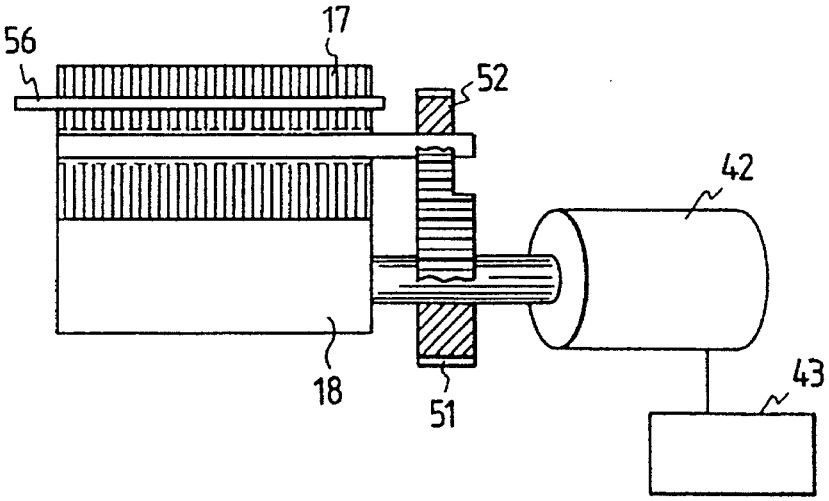
FIG. 23 is a diagrammatic view showing the construction of a main part of a drive system for a brush roller and a collecting roller in FIG. 22.
Figure 22:
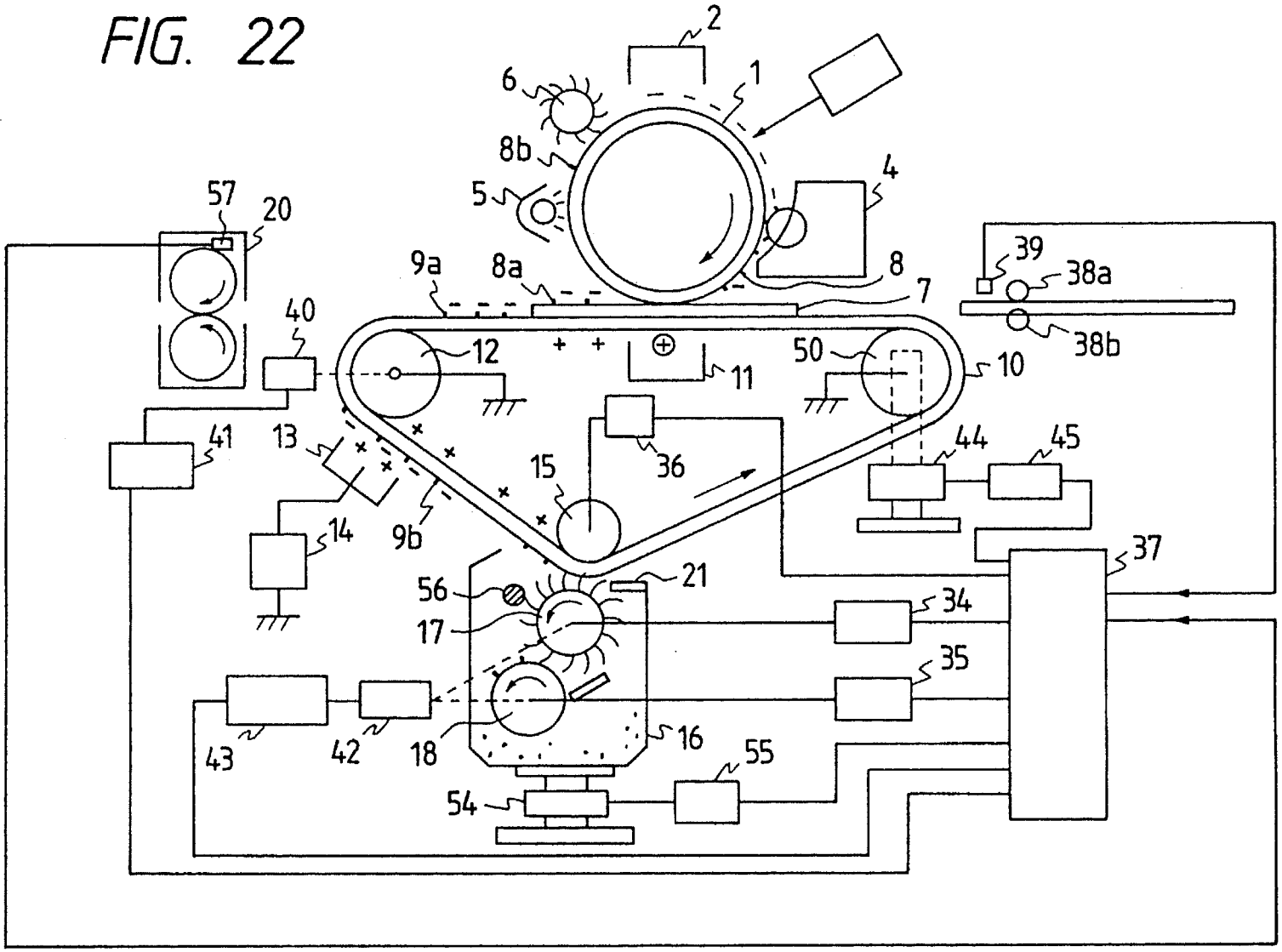
FIG. 22 is a schematic diagram showing the construction of a main part of an electro-static printing apparatus relating to an embodiment in accordance with the present invention.

The numeral 42 represents a cleaner drive motor for driving the brush roller 17 and the collecting roller 18, which motor 42 is powered by a cleaner drive motor power source 43 controlled by a control signal output from the control unit 37. The cleaner drive motor 42 is, as shown in FIG. 23, placed so as to have the same shaft as the collecting roller 18 and is coupled with the brush roller 17 via gears 51 and 52.

Figure 24:
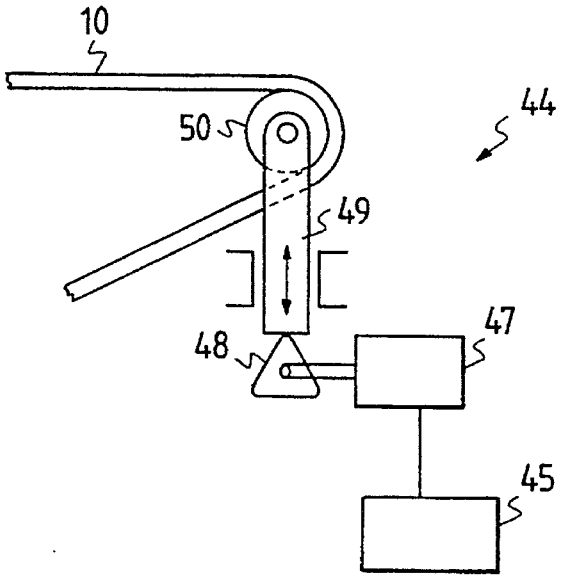
FIG. 24 is a diagrammatic view showing the construction of a drive system for a transfer belt in FIG. 22.

The numeral 44 represents a drive mechanism for rotating the transfer unit about the center of rotation of the rotating shaft of the drive roller 12, which, as shown in FIG. 24, pushes up a driven roller 50, such that the transfer belt 10 may be moved into contact with the photosensitive drum 1 or pulled down the driven roller 50 such that the transfer belt 10 may be separated from the photosensitive drum 1, by moving a push rod 49 upward and downward using a rotating cam 48 driven by a stepping motor 47. The stepping motor 47 is rotated by a transfer unit drive power source 45 controlled by a control signal output from the control unit 37.

The numeral 54 represents a cleaner unit position adjusting mechanism which moves the cleaner unit 16 upward and downward in a direction toward the transfer belt 10 to maintain the scrubbing area of the transfer belt 10 with the brush roller 17 at a given value. The cleaner unit position adjusting mechanism 54 may be constructed as an upward/downward moving mechanism utilizing a screw shaft rotated by a drive motor. The cleaner unit position adjusting mechanism 54 is powered by a position adjust driving power source 55 controlled by a control signal output from the control unit 37.

A flicker bar 56 is provided so as to contact the periphery of the brush roller 17 and flick the brush fiber of the brush roller 17 when the brush roller 17 is being rotated to remove any toner attached to the brush fiber.

The numeral 57 is a temperature sensor for detecting the temperature of a heat roller in the fixing unit 20, and a detected temperature signal is input to the control unit 37.

Figure 25:
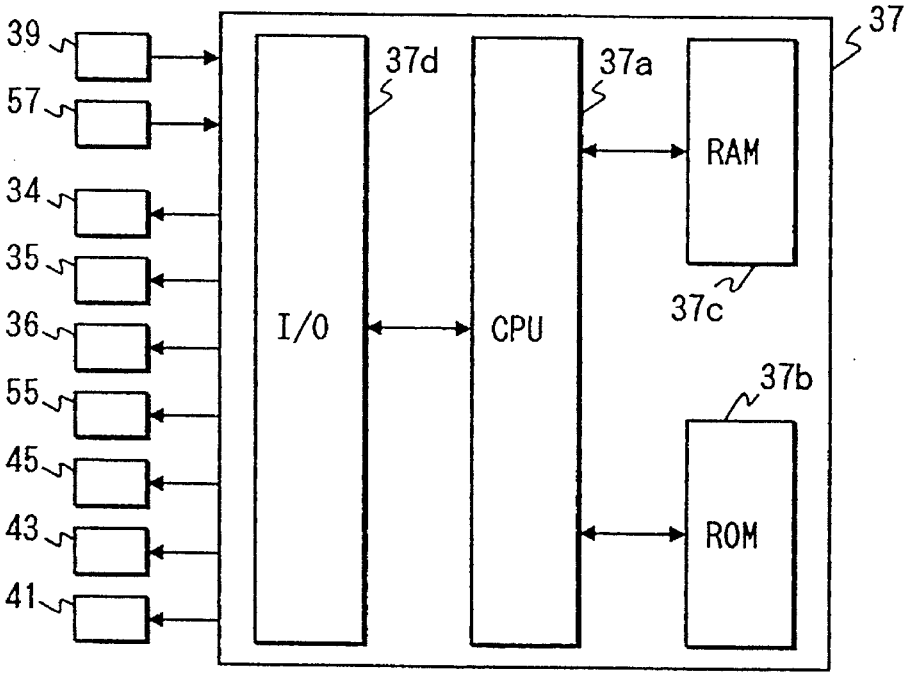
FIG. 25 is a block diagram of a control unit in FIG. 22.

The control unit 37 is, as shown in FIG. 25, constructed of a micro-computer having a CPU 37*a*, an ROM 37*b*, an RAM 37*c* and an I/O board 37*d*.

Figure 26:
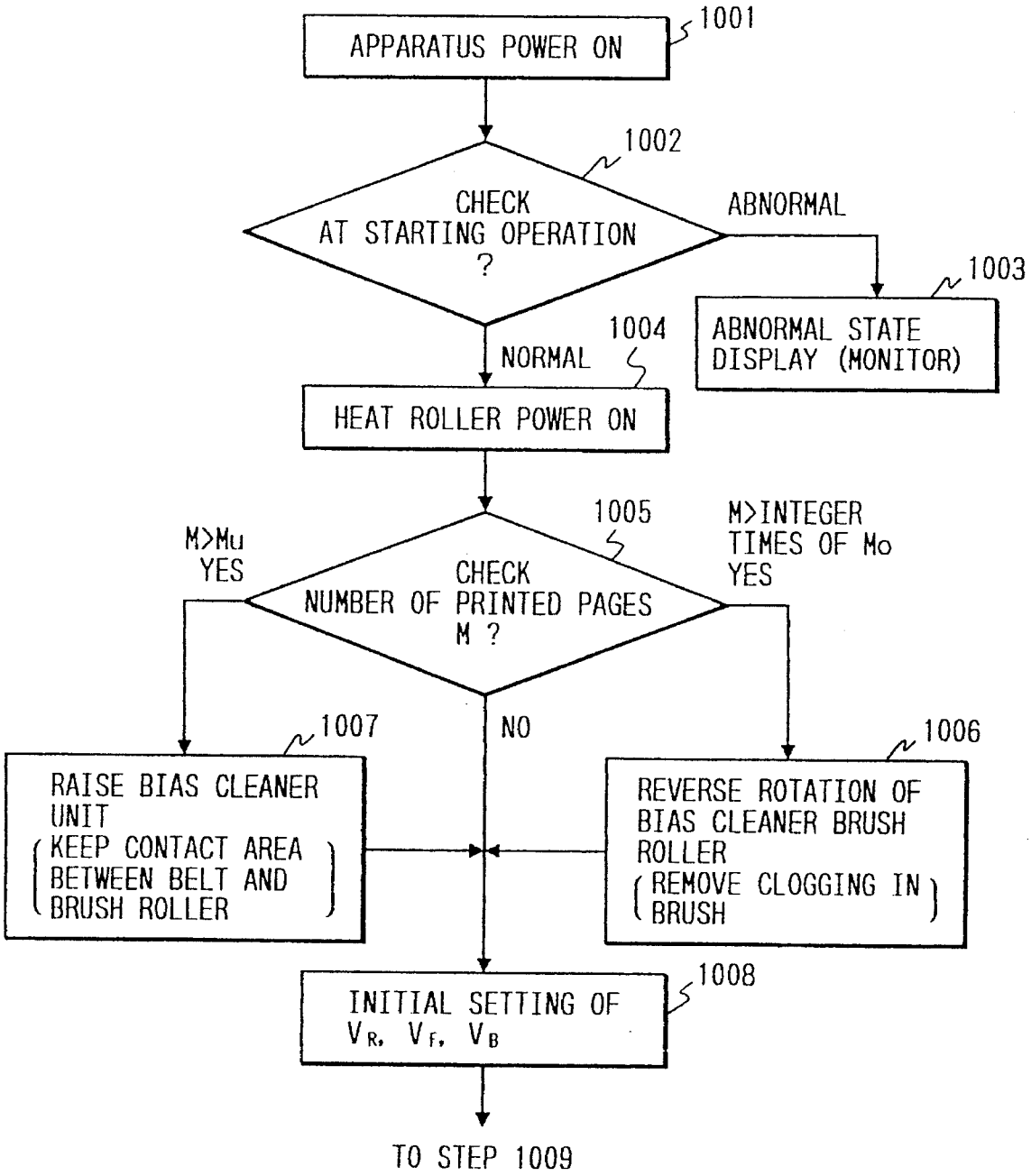
FIG. 26 is a flow-chart of control processing executed by the control unit in FIG. 22.
Figure 27:
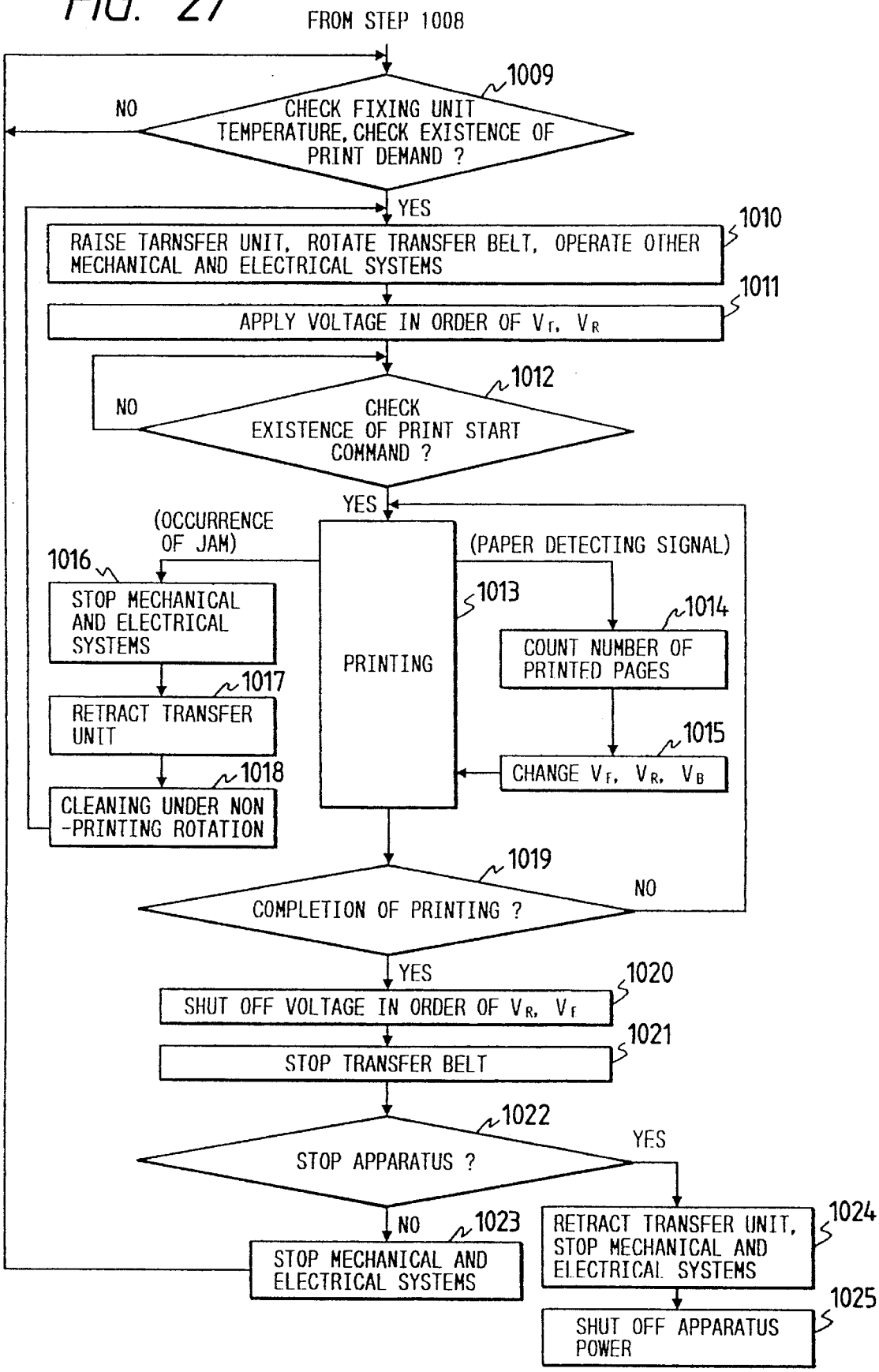
FIG. 27 is a flow-chart of control processing executed by the control unit in FIG. 22.
Figure 28:
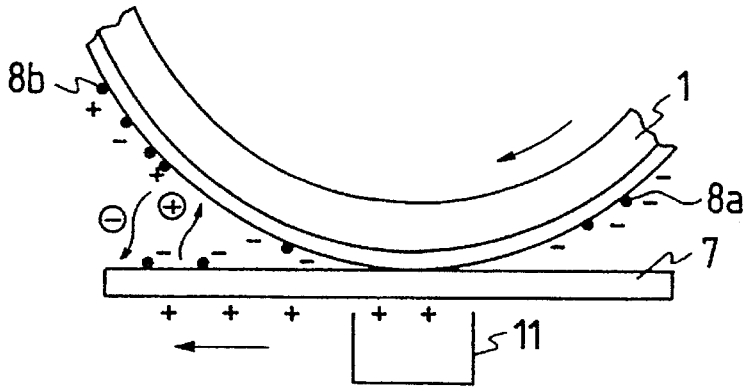
FIG. 28 PRIOR ART
FIG. 28 is a diagrammatic view showing the construction of a main part of a conventional electro-static printing apparatus.
Figure 29:
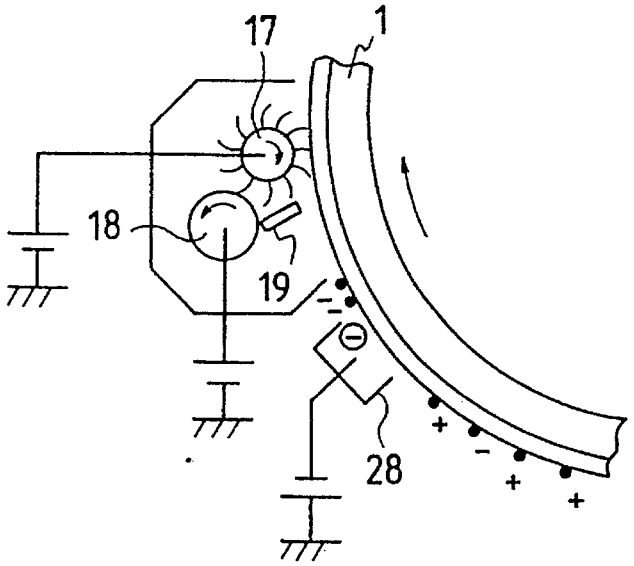
FIG. 29 PRIOR ART
FIG. 29 is a diagrammatic view showing the construction of a main part of another conventional electro-static printing apparatus.

The control processing function in the control unit 37 will be described below, referring to FIG. 26 and FIG. 27.

The control unit 37 is powered on in step 1001, and then the processing proceeds to step 1002 to perform a check process for the starting operation. The check process for the starting operation is a process to check whether there is any abnormality in the printing system and/or in the fixing system. To be more specific, it is a process to check whether there is an abnormality in the rotating state of the photosensitive drum 1, an abnormality in the operating states of the charger 2, 11, 13, an abnormality in the rotating state of the developing unit 4, an abnormality in the rotating state of the transfer belt 10, an abnormality in the operating state of the discharge lamp 5, an abnormality in the rotating state of the drum cleaning brush 6, and an abnormality in the rotating state of the heat roller in the fixing unit 20.

If any abnormality is detected in step 1002, the processing proceeds to step 1003 to display the abnormality. The display of the abnormality is performed with an operation panel or a monitor in an information processing system connected to the electro-static printing apparatus.

If no abnormality is detected, the processing proceeds to step 1004 to start supplying power to the heat roller in the fixing unit 20.

In step 1005, the number of printed pages M is checked to detect the timing for operating the brush roller 17 and the collecting roller 18 to rotate in the opposite direction in order to remove toner and paper powder which have accumulated in the brush roller 17, or to detect a timing for lifting up the cleaner unit 16 in order to compensate for any decrease in the scrubbing area due to bending of the fibers of the brush roller 17. The operation of rotating the brush roller 17 and the collecting roller 18 in the opposite direction is set to be performed every time the number of printed pages M exceeds a pre-set number of printed pages Mo (for example 50 thousand pages). And, the operation of lifting up the cleaner unit 16 is set to be performed every time the number of printed pages exceeds a pre-set number of printed pages Mu. Therefore, in step 1005, a checking is performed to determine whether the number of printed pages M is integer times the set pages Mo or Mu.

If the number of printed pages M is an integer times the set pages Mo, the processing proceeds to step 1006 to perform an operating control for operating the brush roller 17 and the collecting roller 18 to rotate in the opposite direction in order to remove toner and paper powder which have accumulated in the brush roller 17.

If the number of printed pages M is an integer times the set pages Mu. The processing proceeds to step 1007 to perform a control process for lifting up the cleaner unit 16 in order to increase the scrubbed area in the transfer belt 10 by the brush roller 17.

In step 1008, the brush voltage $V_F$, the collecting roller voltage $V_R$ and the opposed roller bias voltage $V_B$ are initialized with reference to past data concerning the number of printed pages M and the like.

In step 1009, checking is performed to determine whether the temperature of the fixing unit 20 has arrived at a given value (for example 190° C.) with reference to the detected signal from the temperature sensor 57 and whether there is a printing demand.

In step 1010, a control process is performed to effect contact between the transfer belt 10 and the photosensitive drum 1 by raising the transfer unit, to rotate the transfer belt 10 and to bring other parts in an operating state.

In step 1011, the required voltages are applied to the brush roller 17 and the collecting roller 18 in the order of the brush voltage $V_F$, and the collecting roller voltage $V_R$.

Existence of a print start command is checked in step 1012. If a print start command has been input, the processing proceeds to step 1013.

In step 1013, a control process for the print operation is executed. On receiving a detected signal from the print paper counting sensor 39, the processing proceeds to step 1014 to update the counted number of printed pages M, and then proceeds to step 1015 to perform a voltage control process for generating a brush voltage $V_F$, a collecting roller voltage $V_R$ and an opposed roller bias voltage $V_B$ suitable for the number of printed pages M.

When a paper jam occurs during the printing operation, the processing proceeds to step 1016 to perform a control process for stopping the operation of the mechanical system and the electrical system, and the processing then proceeds to step 1017 to withdraw the transfer unit.

In step 1018, after resolving the paper jam, a non-printing operating control is performed to clean off any toner on the transfer belt which has been directly transferred from the photosensitive drum thereto. Then, after cleaning, the processing returns to step 1010 again.

In step 1019, a checking is performed to determine whether the printing is completed. If the printing is completed, the processing proceeds to step t020 to stop supplying the voltages in the order of the collecting roller voltage $V_R$, and the brush voltage $V_F$.

In step 1021, rotation of the transfer belt 10 is stopped.

In step 1022, a checking is performed to determine whether an apparatus stop command has been input. If a stop command has not been input, the processing proceeds to step 1023 to perform a stand-by control. In the stand-by control, a control process is performed to bring a state waiting for a print requesting command in which the mechanical system and the electrical system are in a stopped state while the transfer unit is maintained in a raised position.

If a stop command is input, the processing proceeds to step 1024 to retract the transfer belt 10 from the photosensitive drum 1 by lowering the transfer unit, and to perform a control process for stopping the mechanical system and the electrical system. Then the processing proceeds to step 1025 to perform a process for shutting off the apparatus power source.

What is claimed is:

1. A bias cleaning system comprising:

an electrically conductive brush roller for collecting a charge-carrying toner which has adhered on a rotatable toner carrying nonphotosensitive member by scrubbing the toner from the toner carrying member under a condition in which said toner carrying member is rotating in contact with said brush roller and a direct current voltage of opposite polarity to the charge on the toner is applied to said brush roller;

a collecting roller for collecting the toner scrubbed off said toner carrying member by said brush roller by effecting contact between the collecting roller and the electrically conductive brush roller under a condition in which a direct current voltage having the same polarity as and a higher level than the voltage applied to the electrically conductive brush roller is applied to the collecting roller; and toner charge decreasing means for decreasing the amount of charge on the toner carried on the toner carrying member in a region up-stream of the electrically conductive brush roller in the moving direction of the toner carrying member.

2. A bias cleaning system according to claim 1, wherein said toner charge decreasing means is a corona charger which generates a charge having the polarity opposite to the polarity of the charge on the toner.

3. A bias cleaning system according to claim 2, which further comprises means for adjusting a current supplied to the corona charger such that the charge on the toner carried on the toner carrying member becomes larger than 0 (zero) and smaller than 15 μC/g in absolute value without changing the polarity of the charge on the toner.

4. A bias cleaning system according to claim 1, wherein said electrically conductive brush roller has a resistivity per unit area in the range between $10^{-2}$ MΩ/cm$^2$ and 4 MΩ/cm$^2$, the resistivity per unit area being measured by applying a voltage of $(V_R-V_F)$ between the electrically conductive brush roller and the collecting roller and from a contact area Sr, where $V_F$ is a voltage applied to the electrically conductive brush roller, $V_R$ is a voltage applied to the collecting roller, and Sr is a contact area between the electrically conductive brush roller and the collecting roller.

5. A method of operating a bias cleaning system having an electrically conductive brush roller for collecting charge-carrying toner carried on a rotating toner carrying nonphotosensitive member and a collecting roller for collecting toner from said electrically conductive brush roller, comprising the steps of:

scrubbing the rotating toner carrying member using said brush roller under a condition in which a direct current voltage of opposite polarity to the charge on the toner is applied to the electrically conductive brush roller;

contacting the electrically conductive brush roller with said collecting roller under a condition in which a direct current voltage having the same polarity as and a higher level than the voltage applied to the electrically conductive brush roller is applied to the collecting roller;

stopping rotation of the toner carrying member; and then moving said brush roller and said collecting roller in a direction which is opposite to a moving direction of said brush roller and said collecting roller before stopping rotation of the toner carrying member.

6. A method of operating a bias cleaning system having an electrically conductive brush roller for collecting remaining charge-carrying toner on a rotatable toner carrying member and a collecting roller for collecting toner from said electrically conductive brush roller, comprising the steps of:

starting rotation of said toner carrying member;

scrubbing the toner carrying member using said brush roller under a condition in which a direct current voltage of opposite polarity to the charge on the toner is applied to the electrically conductive brush roller; and contacting the electrically conductive brush roller with said collecting roller under a condition in which a direct current voltage having the same polarity as and a higher level than the voltage applied to the electrically conductive brush roller is applied to the collecting roller; wherein said direct current voltage is applied to the electrically conductive brush roller after starting rotation of the toner carrying member, and rotation of the toner carrying member is stopped after turning off the direct current voltage applied to the electrically conductive brush roller.

7. A method of operating a bias cleaning system having an electrically conductive brush roller for collecting remaining charge-carrying toner on a rotatable toner carrying nonphotosensitive member and a collecting roller for collecting roller toner from said electrically conductive brush roller, comprising the steps of:

starting rotation of said toner carrying member;

scrubbing the toner carrying member using said brush roller under a condition in which a direct current voltage of opposite polarity to the charge on the toner is applied to the electrically conductive brush roller; and contacting the electrically conductive brush roller with said collecting roller under a condition in which a direct current voltage having the same polarity as and a higher level than the voltage applied to the electrically conductive brush roller is applied to the collecting roller; wherein a direct current voltage is applied to said collecting roller not before a direct current voltage is applied to said electrically conductive brush roller.

8. A method of operation a bias cleaning system in an electrostatic printing apparatus, in which sheets are supplied to a printing region for printing, having an electrically conductive brush roller for collecting remaining toner charge-carrying on a rotatable toner carrying member and a collecting roller for collecting toner from said electrically conductive brush roller, comprising the steps of:

starting rotation of said toner carrying member;

supplying sheets to said printing region for printing;

scrubbing the toner carrying member under a condition in which a direct current voltage of opposite polarity to the charge on the toner is applied to the electrically conductive brush roller;

contacting the electrically conductive brush roller with said collecting roller under a condition in which a direct current voltage having the same polarity as and a higher level than the voltage applied to the electrically conductive brush roller is applied to the collecting roller; and counting the number of sheets supplied to said printing region; wherein the voltages applied to the electrically conductive brush roller and the collecting roller are increased in a step by step manner corresponding to an increase in the counted number of sheets.

9. A bias cleaning system comprising:

an electrically conductive brush roller for collecting a charge-carrying toner which has adhered on a rotatable toner carrying member by scrubbing the toner from the toner carrying member under a condition in which said toner carrying member is rotating in contact with said brush roller and a direct current voltage of opposite polarity to the charge on the toner is applied to said brush roller;

a collecting roller for collecting the toner scrubbed off said toner carrying member by said brush roller by effecting contact between the collecting roller and the electrically conductive brush roller under a condition in which a direct current voltage having the same polarity as and a higher level than the voltage applied to the electrically conductive brush roller; and an opposed roller placed in opposition to the electrically conductive brush roller with the toner carrying member being interposed therebetween, wherein a high resistivity coating film is formed on at least a part of the opposed roller which is not in contact with the toner carrying member so as to contact directly the electrically conductive brush roller.

10. A bias cleaning system according to claim 9, wherein:

said opposed roller is an aluminum roller, the surface of which is treated by anodic oxidization.

11. A method of operation a bias cleaning system in an electrostatic printing apparatus, in which sheets are supplied to a printing region for printing, having an electrically conductive brush roller for collecting remaining toner charge-carrying nonphotosensitive on a rotatable toner carrying member, a collecting roller for collecting toner from said electrically conductive brush roller and an opposed roller place in opposition to the brush roller with the toner carrying member being interposed therebetween, comprising the steps of:

starting rotation of said toner carrying member;

supplying sheets to said printing region for printing;

scrubbing the toner carrying member under a condition in which a direct current voltage of opposite polarity to the charge on the toner is applied to the electrically conductive brush roller;

contacting the electrically conductive brush roller with said collecting roller under a condition in which a direct current voltage having the same polarity as and a higher level than the voltage applied to the electrically conductive brush roller; wherein the voltage applied to the opposed roller is decreased in a step by step manner corresponding to an increase in a counted number of sheets.

12. An electro-static printing apparatus using a belt transfer system for transferring a charged toner image on a photosensitive body to a print paper sheet by causing the print paper sheet mounted on a rotating transfer belt formed of a dielectric material come into contact with the photosensitive body while applying a charge of opposite polarity to that of the toner to the reverse side surface of the transfer belt, which apparatus comprises:

an electrically conductive brush roller for collecting remaining toner which has adhered on said transfer belt by scrubbing the toner adhering to said transfer belt under a condition in which a direct current voltage of the opposite polarity to that of the charge on the toner is applied to said electrically conductive brush roller;

a collecting roller for collecting from said brush roller toner by contacting the electrically conductive brush roller under a condition in which a direct current voltage having the same polarity as and a higher voltage level than the voltage applied to the electrically conductive brush roller is applied to said collecting roller; and toner charge decreasing means for decreasing the amount of charge on the toner in a region of the transfer belt up-stream of the electrically conductive brush roller in the moving direction of the transfer belt.

13. An electro-static printing apparatus according to claim 12, wherein said toner charge decreasing means is disposed so that a part of the charge generated by said toner charge decreasing means is applied to the reverse side surface of a paper sheet a the position where the paper sheet is peeled off from the transfer belt and the remainder of the charge is applied to any toner remaining on the transfer belt.

14. An electro-static printing apparatus according to claim 12, wherein said toner charge decreasing means operates to decrease the amount of charge on the toner on said transfer belt corresponding to the rotating time of the transfer belt during a reset non-printing rotation cleaning time in which the transfer belt is retracted from the photosensitive body and toner remaining on the transfer belt is cleaned using the electrically conductive brush roller while the transfer belt is being rotated.

15. An electro-static printing apparatus according to claim 12, wherein said toner charge decreasing means operates to decrease the amount of charge on any toner remaining on the transfer belt with the transfer belt being retracted from the photosensitive body and the remaining toner on the transfer belt being cleaned using the electrically conductive brush roller while the transfer belt is being rotated.

16. An electro-static printing apparatus of intermediate transfer body type in which contact is effected between an intermediate transfer body made of a dielectric material and a photosensitive body having a charged toner image formed thereon, the charged toner image on the photosensitive body is transferred to the intermediate transfer body, and the toner image on the intermediate transfer body is transferred to a print paper sheet, which apparatus comprises:

an electrically conductive brush roller for collecting remaining toner which has adhered on the intermediate transfer body by scrubbing the intermediate transfer body under a condition in which a direct current voltage of opposite polarity to that of the charge on the toner is applied to said electrically conductive brush roller;

a collecting roller for collecting toner from said brush roller by of contacting the electrically conductive brush roller under a condition in which a direct current voltage having the same polarity as and a higher voltage level than the voltage applied to the electrically conductive brush roller is applied to the collecting roller; and toner charge decreasing means for decreasing the amount of charge on the toner in the region of the intermediate transfer body up-stream of the electrically conductive brush roller in the moving direction of the intermediate transfer body.

17. An electro-static printing apparatus according to claim 16, wherein said toner charge decreasing means operates to decrease the amount of charge on the toner corresponding to the rotating time of the intermediate transfer body during a reset non-printing rotation cleaning time in which the intermediate transfer body is retracted from the photosensitive body and toner remaining on the intermediate transfer body is cleaned using the electrically conductive brush roller while the intermediate transfer body is being rotated.

18. An electro-static printing apparatus according to claim 16, wherein said toner charge decreasing means operates to decrease the amount of charge on any toner remaining on the intermediate transfer body with the intermediate transfer body being retracted from the photosensitive body and the remaining toner on the intermediate transfer body being cleaned using the electrically conductive brush roller while the intermediate transfer body is being rotated.

19. A bias cleaning system comprising:

an electrically conductive brush roller for collecting a charge-carrying toner which has adhered on a rotatable toner carrying nonphotosensitive member by scrubbing the toner from the toner carrying member under a condition in which said toner carrying member is rotating in contact with said brush roller and a direct current voltage of opposite polarity to the charge on the toner is applied to said brush roller;

a collecting roller for collecting the toner scrubbed off said toner carrying member by said brush roller by effecting contact between the collecting roller and the electrically conductive brush roller under a condition in which a direct current voltage having the same polarity as and a higher level than the voltage applied to the electrically conductive brush roller is applied to the collecting roller; and control means for moving said brush roller and said collecting roller in a reverse direction opposite to the moving direction thereof during scrubbing of the toner carrying member before stopping of the toner carrying member.

20. A bias cleaning system comprising:

an electrically conductive brush roller for collecting a charge-carrying toner which has adhered on a rotatable toner carrying nonphotosensitive member by scrubbing the toner from the toner carrying member under a condition in which said toner carrying member is rotating in contact with said brush roller and a direct current voltage of opposite polarity to the charge on the toner is applied to said brush roller;

a collecting roller for collecting the toner scrubbed off said toner carrying member by said brush roller by effecting contact between the collecting roller and the electrically conductive brush roller under a condition in which a direct current voltage having the same polarity as and a higher level than the voltage applied to the electrically conductive brush roller is applied to the collecting roller; and control means for applying said direct current voltage to said electrically conductive brush roller after starting rotation of the toner carrying member and for stopping rotation of the toner carrying member after turning off the direct current voltage applied to the electrically conductive brush roller.

21. A bias cleaning system comprising:

an electrically conductive brush roller for collecting a charge-carrying toner which has adhered on a rotatable toner carrying member by scrubbing the toner from the toner carrying member under a condition in which said toner carrying member is rotating in contact with said brush roller and a direct current voltage of opposite polarity to the charge on the toner is applied to said brush roller;

a collecting roller for collecting the toner scrubbed off said toner carrying member by said brush roller by effecting contact between the collecting roller and the electrically conductive brush roller under a condition in which a direct current voltage having the same polarity as and a higher level than the voltage applied to the electrically conductive brush roller is applied to the collecting roller; and control means for applying said direct current voltage to said collecting roller not before a direct current voltage is applied to said electrically conductive brush roller.

22. A bias cleaning system comprising:

an electrically conductive brush roller for collecting a charge-carrying toner which has adhered on a rotatable toner carrying nonphotosensitive member by scrubbing the toner from the toner carrying member under a condition in which said toner carrying member is rotating in contact with said brush roller and a direct current voltage of opposite polarity to the charge on the toner is applied to said brush roller;

a collecting roller for collecting the toner scrubbed off said toner carrying member by said brush roller by effecting contact between the collecting roller and the electrically conductive brush roller under a condition in which a direct current voltage having the same polarity as and a higher level than the voltage applied to the electrically conductive brush roller is applied to the collecting roller;

means for supplying sheets to a printing zone for printing; and control means for increasing the voltages applied to the electrically conductive brush roller and the collecting roller in a step by step manner corresponding to an increase in a number of sheets supplied to said printing zone.

23. A bias cleaning system comprising:

an electrically conductive brush roller for collecting a charge-carrying toner which has adhered on a rotatable toner carrying nonphotosensitive member by scrubbing the toner from the toner carrying member under a condition in which said toner carrying member is rotating in contact with said brush roller and a direct current voltage of opposite polarity to the charge on the toner is applied to said brush roller;

a collecting roller for collecting the toner scrubbed off said toner carrying member by said brush roller by effecting contact between the collecting roller and the electrically conductive brush roller under a condition in which a direct current voltage having the same polarity as and a higher level than the voltage applied to the electrically conductive brush roller is applied to the collecting roller;

an opposed roller placed in opposition to the electrically conductive brush roller with the toner carrying member being interposed therebetween, said opposed roller having a direct current voltage applied thereto;

means for supplying sheets to a printing zone for printing; and control means for decreasing the voltage applied to the opposed roller in a step by step manner corresponding to an increase in a number of sheets supplied said printing zone.

24. A bias cleaning system comprising:

an electrically conductive brush roller for collecting a charge-carrying toner which has adhered on a rotatable toner carrying nonphotosensitive member by scrubbing the toner from the toner carrying member under a condition in which said toner carrying member is rotating in contact with said brush roller and a direct current voltage of opposite polarity to the charge on the toner is applied to said brush roller;

a collecting roller for collecting the toner scrubbed off said toner carrying member by said brush roller by effecting contact between the collecting roller and the electrically conductive brush roller under a condition in which a direct current voltage having the same polarity as and a higher level than the voltage applied to the electrically conductive brush roller is applied to the collecting roller;

toner charge decreasing means for decreasing the amount of charge on the toner on the toner carrying member in a region up-stream of the electrically conductive brush roller in the moving direction of the toner carrying member; and a flicker bar acting on brush fibers in the electrically conductive brush roller to remove toner therefrom.

25. An electrically conductive brush roller for use in a bias cleaning system, said bias cleaning system comprising:

an electrically conductive brush roller for collecting a charge-carrying toner which has adhered on a rotatable toner carrying a non-photosensitive member by scrubbing the toner from the toner carrying non-photosensitive member under a condition in which said toner carrying non-photosensitive member is rotating in contact with said brush roller and a direct current voltage of opposite polarity to the charge on the toner is applied to said brush roller;

a collecting roller for collecting the toner scrubbed off said toner carrying non-photosensitive member by said brush roller by effecting contact between the collecting roller and the electrically conductive brush roller under a condition in which a direct current voltage having the same polarity as and a higher level than the voltage applied to the electrically conductive brush roller is applied to the collecting roller; and toner charge decreasing means for decreasing the amount of charge on the toner carried on the toner carrying non-photosensitive member in a region up-stream of the electrically conductive brush roller in the moving direction of the toner carrying non-photosensitive member;

wherein said electrically conductive brush roller includes a resistivity per unit area in the range between $10^{-2}$ M $\Omega/cm^2$ and 4 M $\Omega/cm^2$ and a high cleaning efficiency when the amount of charge on the toner carried on the toner carrying non-photosensitive member is reduced to 15 μC/g or less.

* * * * *

UNITED STATES PATENT AND TRADEMARK OFFICE

CERTIFICATE OF CORRECTION

PATENT NO. : 5,600,405

DATED : Feb. 4, 1997

INVENTOR(S) : UMEDA, et al

It is certified that error appears in the above-indentified patent and that said Letters Patent is hereby corrected as shown below:

On the title page:

Please correct [73] Assignee: to read as follows:

--[73] Assignee: Hitachi Koki Co., Ltd. &
Hitachi, Ltd., both of
Tokyo, Japan--

Signed and Sealed this

Nineteenth Day of August, 1997

*Attest:*

*Attesting Officer*

BRUCE LEHMAN

*Commissioner of Patents and Trademarks*